US008766749B2

(12) United States Patent
Ganley et al.

(10) Patent No.: US 8,766,749 B2
(45) Date of Patent: Jul. 1, 2014

(54) MINIATURE CIRCUIT BREAKER

(75) Inventors: Sean Christopher Ganley, Abergele (GB); John Stevens, Manchester (GB)

(73) Assignee: Eaton Industries Manufacturing GmbH, Morges (CH)

( * ) Notice: Subject to any disclaimer, the term of this patent is extended or adjusted under 35 U.S.C. 154(b) by 149 days.

(21) Appl. No.: 13/393,923

(22) PCT Filed: Sep. 3, 2010

(86) PCT No.: PCT/GB2010/001669
§ 371 (c)(1),
(2), (4) Date: Jul. 13, 2012

(87) PCT Pub. No.: WO2011/027120
PCT Pub. Date: Mar. 10, 2011

(65) Prior Publication Data

US 2012/0273334 A1 Nov. 1, 2012

(30) Foreign Application Priority Data

Sep. 3, 2009 (GB) ..... 0915379.2

(51) Int. Cl.
*H01H 9/00* (2006.01)
*H01H 71/24* (2006.01)
*H01H 71/70* (2006.01)
*H01H 71/74* (2006.01)

(52) U.S. Cl.
CPC ..... *H01H 71/2409* (2013.01); *H01H 71/70* (2013.01); *H01H 71/74* (2013.01)
USPC ..... 335/173; 335/23; 335/172; 335/174; 335/175; 335/176

(58) Field of Classification Search
USPC ..... 335/172–176, 23, 30, 65, 68, 118
See application file for complete search history.

(56) References Cited

U.S. PATENT DOCUMENTS 4,631,507 A * 12/1986 Guery et al. ..... 335/27
4,679,019 A 7/1987 Todaro et al.

(Continued)

FOREIGN PATENT DOCUMENTS

EP 0827251 A2 3/1998
EP 0880159 A2 11/1998
EP 1331658 A1 7/2003

OTHER PUBLICATIONS

European Patent Office; International Search Report and Written Opinion issued in corresponding International Application No. PCT/GB2010/001669. Date of Mailing: Apr. 21, 2011.

*Primary Examiner* — Mohamad Musleh
(74) *Attorney, Agent, or Firm* — Dykema Gossett PLLC

(57) ABSTRACT

A miniature circuit breaker having a pair of operable contacts in a main current path between a line terminal and load terminal, a trip mechanism for opening the contacts if an overcurrent condition occurs, and an electric motor to close the contacts via a contact closing mechanism. The trip mechanism includes a trigger mechanism and a contact opening mechanism, a current sensor arranged to detect current through the main current path, and a control unit. The trigger mechanism triggers the contact opening mechanism if a trip signal is produced. The control unit produces a trip signal to operate the trigger mechanism if it determines a short circuit condition occurs based on output of the current sensor; and the control unit is arranged to operate the electric motor to trigger the contact opening mechanism into opening the contacts independently of the trigger mechanism if it determines that an overload condition occurs.

20 Claims, 13 Drawing Sheets

(56) References Cited

U.S. PATENT DOCUMENTS 5,163,175 A * 11/1992 Mori et al. ..... 335/132
5,252,933 A * 10/1993 Kamino et al. ..... 335/172
5,821,839 A * 10/1998 Heise et al. ..... 335/35
6,218,921 B1 4/2001 Eberts et al.
8,138,862 B2 * 3/2012 Mueller et al. ..... 335/172
2001/0022268 A1 9/2001 Guille et al.
2006/0071742 A1 * 4/2006 Castonguay et al. ..... 335/20
2009/0237190 A1 * 9/2009 Nyzner ..... 335/174
2010/0164659 A1 * 7/2010 Ohtsuka et al. ..... 335/174

* cited by examiner

MINIATURE CIRCUIT BREAKER

CROSS-REFERENCE TO RELATED APPLICATIONS

This application is a national stage filing based upon International PCT Application No. PCT/GB2010/001669, with an international filing date of Sep. 3, 2010, which claims the benefit of priority to Great Britain Patent Application No. 0915379.2, filed Sep. 3, 2009, both of which applications are fully incorporated herein by reference as though fully set forth herein.

This invention relates to a miniature circuit breaker.

A circuit breaker is an electrical switch for protecting a load from being supplied with an overcurrent, i.e. a current which exceeds a rated current of the load. A circuit breaker typically includes a pair of openable contacts located in the main current path between a power supply and a load and is arranged to open the contacts in the event of an overcurrent condition, so as to interrupt the continuity of the power supply.

A miniature circuit breaker (referred to as an "MCB" herein) is a circuit breaker of the type used to protect control circuits or domestic appliances and typically having a rated current of 125 Amps or less, a rated voltage of 440 Volts (between phases) or less and a rated short-circuit capacity of 25000 Amps or less. The physical outline of MCBs generally follow the dimensions prescribed by the DIN 43880 standard [EN 60898-1:2003]. Normally, a domestic installation will have a plurality of MCBs installed on a breaker panel (also known as a "distribution board" or "fusebox").

A conventional MCB comprises a pair of contacts located in a main current path between a line terminal for connecting to a power supply and a load terminal for connecting to a load to be powered by the power supply. The conventional MCB further includes a trip mechanism for opening the contacts if an overcurrent condition occurs. The trip mechanism usually includes a bimetal component for triggering a contact opening mechanism into opening the contacts if an overload condition occurs and a solenoid for triggering the contact opening mechanism into opening the contacts if a short circuit condition occurs. An overload condition is an overcurrent condition in which there is a slowly changing overcurrent through the main current path which could cause overheating of a load. A short circuit condition is an overcurrent condition in which there is a large surge of overcurrent through the main current path.

The contact opening mechanism is a spring-based mechanism which releases stored mechanical energy to open the contacts. The conventional MCB further includes a manually operable lever to close the contacts after they have been opened by the trip mechanism and also to prime the trip mechanism by supplying mechanical energy to the contact opening mechanism.

The bimetal component is located in main current path of the MCB. If an overcurrent flows through the main current path then the bimetal begins to heat up. Continued heating due to a prolonged overcurrent causes the bimetal to deform until deformation of the bimetal produces a force to trigger the contact opening mechanism into opening the contacts by moving a trip lever.

The solenoid has a coil located in the main current path of the MCB. An armature of the solenoid is held in place by a retaining spring, but when there is a large surge of overcurrent (i.e. a short circuit overcurrent) through the main current path, the coil generates a magnetic field which acts on the armature with a force which overcomes the retaining spring so as to move the armature to trigger the contact opening mechanism into opening the contacts by moving a trip lever.

When a very large short circuit overcurrent flows through the main current path, the coil of the solenoid generates a large magnetic field which produces a large force which acts on the armature of the solenoid. This moves the armature of the solenoid at high speed into contact with the trip lever, thus triggering the contact opening mechanism in a very short period of time. Moreover, because the armature moves at high speed, it strikes the trip lever with a large amount of force which causes the trip lever to move into contact with a movable one of the contacts so as to mechanically assist in the opening of the contacts, i.e. in addition to triggering the contact opening mechanism. This mechanical assistance helps to prevent the contacts from being welded together due to the very large current flowing between the contacts. This welding together of the contacts is known as "tack" welding and is a danger at very large short circuit currents, e.g. 1000 A to 2000 A.

The conventional MCB described above is very well known and has a design which provides a good level of overcurrent protection at a low cost.

This invention is concerned with various modifications to the conventional MCB design described above. These modifications are intended to overcome and/or ameliorate problems which the inventors have found to be associated with the conventional MCB, as discussed below.

At its most general, a first aspect of the invention provides an MCB in which a sensor detects current through the main current path, and in which a trip mechanism is triggerable based on an output of the sensor. For example, the trip mechanism may have a control unit arranged to produce a trip signal to trigger the trip mechanism into opening the contacts of the MCB if the control unit determines that an overcurrent condition occurs based on the output of the sensor, e.g. based on a value representative of current through a main current path of the MCB.

The time taken for an MCB to open its contacts in response to an short circuit condition may be termed the "disconnect time" of the MCB. As explained above, the trip mechanism of a conventional MCB is triggered into opening the contacts of the MCB by a solenoid whose coil is located in the main current path of the MCB. The disconnect time of this conventional MCB is dependent on the amount of time taken for the armature of the solenoid to overcome a retaining spring so as to be fired from the solenoid after a short circuit overcurrent begins. This time is in turn dependent on the point in the voltage waveform of the current in the main current path when the short circuit overcurrent begins since, if an overcurrent begins at the wrong point in the voltage waveform, there may be insufficient energy available for the armature of the solenoid to overcome the retaining spring until a later half-cycle of the voltage waveform. Therefore, the disconnect time of a conventional MCB can typically vary between about 4 and 9 ms, depending on the point in the voltage waveform at which the short circuit overcurrent begins.

An MCB according to the first aspect of the invention may trigger the trip mechanism as soon as an overcurrent is detected by the sensor, and need not be limited by the amount of energy available in the main current path when the overcurrent begins. Thus, the MCB may have a disconnect time which is shorter and/or more consistent than a conventional MCB. A shorter disconnect time is advantageous because it means that less energy is let through the MCB in the event of a short circuit overcurrent.

It is noted that neither the solenoid nor the bimetal component of conventional MCBs is able to detect a current through the main current path of an MCB. Moreover, neither the solenoid nor the bimetal component determines whether an overcurrent condition occurs based on the output of a sensor. Rather, the solenoid and bimetal component are reactive elements which undergo a physical change in response to an overcurrent condition, the physical change causing the contact opening mechanism to be triggered.

The first aspect of the invention may therefore provide an MCB having:

a pair of openable contacts located in a main current path between a line terminal and a load terminal; and a trip mechanism for opening the contacts if an overcurrent condition occurs, the trip mechanism including:

a current sensor arranged to detect current through the main current path; and a control unit arranged to produce a trip signal to trigger the trip mechanism into opening the contacts if it determines that an overcurrent condition occurs based on an output of the current sensor.

The overcurrent condition which occurs may, for example, be a short circuit condition, i.e. a large surge of overcurrent, or an overload condition, i.e. a slowly changing overcurrent which could cause overheating of a load. Such overcurrent conditions are well understood and the control unit may be arranged to determine whether an overcurrent condition occurs based on the output of the current sensor accordingly. The control unit may be any suitable unit which is able to make a determination of whether an overcurrent condition exists. For example, the control unit may be provided with circuitry appropriate for making such a determination.

The current sensor may be any element which can be used to detect current. The output of the current sensor may be a signal having a value representative of current through the main current path. Current sensors are well known and are not discussed in detail herein. For example, the current sensor could include a current transducer which provides a current representative of the current through the main current path. Other types of current sensor may also be appropriate.

The trip signal is not limited to any particular type of signal. The trip signal may be different according to which overcurrent condition is determined to have occurred. Thus, the trip signal may be a short circuit trip signal if the control unit determines that a short circuit condition occurs (e.g. if current exceeds a threshold value) or an overload trip signal if the control unit determines that an overload condition occurs (e.g. if current exceeds a threshold value for a predetermined amount of time).

The trip mechanism may include a trigger mechanism and a contact opening mechanism, the trigger mechanism being arranged to trigger the contact opening mechanism into opening the contacts if the trip signal is produced.

The contact opening mechanism may be any suitable mechanism which is capable of opening the contacts if triggered. The contact opening mechanism may resemble the contact opening mechanism of a conventional MCB.

Thus, the contact opening mechanism may include a mechanical energy store, e.g. a spring or plural springs, arranged to release stored mechanical energy to open the contacts if the contact opening mechanism is triggered. The contact opening mechanism may include a latch, e.g. a mechanical latch, arranged such that the mechanical energy store releases stored mechanical energy to open the contacts if the latch is released. Thus, the trigger mechanism may be arranged to trigger the contact opening mechanism by releasing the latch. The latch may be released by movement of a trip lever, for example.

The trigger mechanism may include an electromechanical actuator arranged to be operated by the trip signal to trigger the contact opening mechanism into opening the contacts if the trip signal is produced. The trigger mechanisms of conventional MCBs include a solenoid and a bimetal component. Although the solenoid and bimetal component of the conventional MCB are electromechanical actuators, they are directly actuated by an overcurrent in the main current path, rather than by a trip signal from a control unit as in the first aspect of the invention.

The electromechanical actuator may include a solenoid. A solenoid typically includes a coil and an armature. The coil may be arranged to be operated by the trip signal into producing a force to act on the armature if the trip signal is produced.

Preferably, the electromechanical actuator includes a magnetically latchable solenoid actuator, e.g. as described in connection with the third aspect of the invention.

The trip signal produced by the control unit may be a trip current, i.e. a current for operating the electromechanical actuator. Thus, the electromechanical actuator may be operated by a current supplied by the control unit rather than by a current supplied directly from the main current path as in a conventional MCB.

The control unit may include an electrical energy store arranged to produce the trip current. The electrical energy store may include, for example, a capacitor or a battery. A capacitor is preferable as the electrical energy store, since a capacitor is typically able to provide a quick discharge of a relatively large current. This may help the electromechanical actuator to produce a large force when operated by the trip current.

The electromechanical actuator may trigger the contact opening mechanism via one or more other components in the trigger mechanism. Preferably, the trigger mechanism is as described in connection with the third aspect of the invention, with the trip signal being used to actuate the electromechanical actuator. Therefore, the trigger mechanism may include:

an electromechanical actuator arranged to be operated by the trip signal to produce a first trigger force;

a force transfer mechanism arranged to transform the first trigger force into a second trigger force larger than the first trigger force;

wherein the force transfer mechanism couples the electromechanical actuator to a contact opening mechanism such that the second trigger force triggers the contact opening mechanism into opening the contacts. As explained in more detail in connection with the third aspect of the invention, a particular advantage of this arrangement is that the force transfer mechanism is able to amplify the force produced by the electromechanical actuator so as to mechanically assist in the opening of the contacts by the contact opening mechanism. Such mechanical assistance may be difficult to achieve without this force amplification.

The control unit may be arranged to trigger the contact opening mechanism into opening the contacts independently of the trigger mechanism. For example, the control unit may be arranged to operate an electromechanical actuator (such as the electric motor described in connection with the second aspect of the invention) to trigger the contact opening mechanism independently of the trigger mechanism. This may help to save wear on the trigger mechanism, which may include a component susceptible to wear, such as a latch and/or spring.

The control unit may be arranged to produce the trip signal to operate the trigger mechanism to trigger the contact opening mechanism into opening the contacts if it determines that a short circuit condition occurs, e.g. by producing a short circuit trip signal. This may be useful because the contacts should be opened as quickly as possible in short circuit conditions. On the other hand, the contacts do not need to be opened as quickly in overload conditions. Therefore the control unit may be arranged to trigger the contact opening mechanism into opening the contacts independently of the trigger mechanism if it determines that an overload condition occurs, e.g. by producing an overload trip signal. This may help to save wear on the trigger mechanism.

The control unit may be arranged to determine whether an overcurrent condition occurs based on a threshold value (or a plurality of threshold values). The control unit may be arranged to determine that a short circuit condition occurs if current in the main current path exceeds a threshold value. The control unit may be arranged to determine that an overload condition occurs if current in the main current path exceeds a threshold value for a predetermined amount of time.

The threshold value(s) may be adjustable. Thus, a user may be able to adjust the overcurrent(s) at which the control unit trips the trip mechanism into opening its contacts by adjusting the threshold value(s). The threshold value(s) may be adjustable over a predetermined range of values. A limit may be placed on the range of values over which the threshold value can be adjusted by the range of currents measurable by the current sensor. However, even if this is the case, the threshold current at which the MCB opens the contacts may be adjustable over a much wider range than in a conventional MCB, where the current at which the MCB opens the contacts can only be adjusted in very small amounts by physically adjusting the solenoid or bimetal component of the MCB (e.g. using a calibration screw) or by replacing the solenoid or bimetal component.

The control unit may be arranged to determine whether an overcurrent condition occurs based on a rated current ($I_n$), an instantaneous tripping current and/or an instantaneous tripping type. "Rated current" ($I_n$) can be defined as the current an MCB is designed to carry continuously (without tripping). Instantaneous tripping current can be defined as the minimum current at which an MCB opens its contacts within a period of 100 ms, it is usually defined in multiples of $I_n$ (rated current). Ranges of instantaneous rated currents can be classified according to an instantaneous tripping type as follows:

Type B: 3-5$I_n$

Type C: 5-10$I_n$

Type D: 10-20$I_n$

The rated current, instantaneous tripping current and/or instantaneous tripping type may be adjustable.

The control unit may be arranged to close the contacts via a contact closing mechanism, e.g. by operating a closing actuator such as an electric motor. Thus, the contacts may be closed by the control unit as required, rather than by being manually closed by a user. This allows the control unit to act as an on/off switch for the main current path.

The MCB may include an electric motor and a contact closing mechanism as described in connection with the second aspect of the invention. The control unit may be arranged to operate the electric motor to close the contacts via the contact closing mechanism. The control unit may be arranged to operate the electric motor to open the contacts independently of a trigger mechanism, e.g. by triggering a contact opening mechanism.

The MCB may include a closing actuator and a contact closing mechanism as described in connection with the fourth aspect of the invention. The control unit may be arranged to operate the closing actuator to close the contacts.

At its most general, a second aspect of the invention provides an MCB having an electric motor operable to close the contacts of the MCB. As explained above, the contacts in a conventional MCB are closed by a manually operable lever. The inventors have found it advantageous to use an electric motor to close the contacts of an MCB because this permits automatic closing of the contacts of an MCB, i.e. closing of the contacts without user intervention. The electric motor be operable to close the contacts via a contact closing mechanism.

The inventors have found that an electric motor is highly suitable for use as an actuator to automatically close (and open) the contacts of an MCB because electric motors are able to produce relatively large forces, i.e. torque, with respect to their size. The amount of force producable by the electric motor is important since a large amount of force may be needed to close the contacts of the MCB and/or to supply mechanical energy to other mechanisms within the MCB (such as a trigger mechanism or a contact opening mechanism).

The second aspect of the invention may therefore provide an MCB having:

a pair of openable contacts located in a main current path between a line terminal and a load terminal;

a trip mechanism for opening the contacts if an overcurrent condition occurs; and an electric motor operable to close the contacts via a contact closing mechanism.

The MCB may have a housing for containing its components, e.g. the contacts, the electric motor, the contact closing mechanism and/or the trip mechanism. The invention may therefore provide an MCB having a housing, e.g. of conventional size, which contains the electric motor.

The housing of the MCB (which contains the electric motor) preferably complies with the DIN 43880 standard. The DIN 43880 standard recommends three different housing (or frame) sizes, which are referred to as sizes "1", "2" and "3".

The housing of the MCB of the second aspect of the invention preferably complies with the size "1" DIN 43880 standard, since most MCBs are size "1". The DIN 43880 size "1" standard specifies a pole width of 17.5 mm to 18 mm, a terminal to terminal size of 90 mm, a front height from a DIN mounting rail of 70 mm and a "shoulder" width of 44.5 mm to 45.5 mm. The DIN 43880 standard allows for deviations from the front height from a DIN mounting rail of 70 mm, and therefore the housing of the MCB of the second aspect of the invention may exceed this 70 mm guideline but comply with the DIN 43880 standard in other respects.

As described above, a conventional MCB has a solenoid and a bimetal component for triggering a contact opening mechanism into opening its contacts. The solenoid assembly is usually designed to cater for currents of up to 63 Amps and therefore occupies a large amount of the volume within the conventional MCB. Similarly, the bimetal component assembly, which may include heaters for low rating performance, also occupies a large amount of volume within the conventional MCB. The space occupied by the bimetal component assembly is necessarily large because it must allow for calibration adjustment, deflection of the bimetal component under overload conditions and excess deflection of the bimetal component under short circuit overcurrents, without ever being overconstrained such that overstressing and/or loss of calibration of the bimetal component becomes a risk. Therefore, a conventional MCB is already filled with mechanisms and actuators such that it would be extremely difficult to include an electric motor within the confines of a conventional MCB housing, in particular those housings which comply with the DIN 43880 standard.

The trip mechanism of the MCB may include a current sensor arranged to detect current through the main current path; and a control unit arranged to produce a trip signal to trigger the trip mechanism into opening the contacts if it determines that an overcurrent condition occurs based on an output of the current sensor. By having a trip mechanism including a current sensor and a control unit, it is not necessary for the MCB to have the large solenoid and bimetal component assemblies that are present in the conventional MCB. The absence of the solenoid and bimetal component assemblies may therefore allow an electric motor to be fitted within the confines of an MCB housing more easily. The trip mechanism including the current sensor and control unit may be as described in connection with the first aspect on the invention.

The trip mechanism may include a trigger mechanism and a contact opening mechanism, the trigger mechanism being arranged to trigger the contact opening mechanism into opening the contacts if an overcurrent condition occurs.

The contact opening mechanism may be any suitable mechanism which is capable of opening the contacts if an overcurrent condition occurs. The contact opening mechanism may resemble the contact opening mechanism of a conventional MCB.

Thus, the contact opening mechanism may include a mechanical energy store, e.g. a spring or plural springs, arranged to release stored mechanical energy to open the contacts if the contact opening mechanism is triggered. The contact opening mechanism may include a latch for its mechanical energy store, e.g. a mechanical latch. The latch may be arranged such that the mechanical energy store releases stored mechanical energy to open the contacts if the latch is released. Thus, the trigger mechanism may be arranged to trigger the contact opening mechanism by releasing the latch. The latch may be released by movement of a trip lever, for example.

The trigger mechanism may include a mechanical energy store, e.g. a spring or plural springs, arranged to release stored mechanical energy to trigger the contact opening mechanism if an overcurrent condition occurs. For example, the trigger mechanism may be as described in connection with the third aspect of the invention, in which the force transfer mechanism may include a mechanical energy store. However, the trigger mechanism need not have a mechanical energy store, e.g. it may be a solenoid or bimetal component as in a conventional MCB.

The electric motor may be operable to prime the trip mechanism by supplying mechanical energy to a mechanical energy store of the trip mechanism, e.g. to the mechanical energy store of the contact opening mechanism (if present) and/or to the mechanical energy store of the trigger mechanism (if present). Thus, the trip mechanism may be primed without a user manually supplying the mechanical energy to the mechanical energy store(s), unlike a conventional MCB where mechanical energy is supplied to a contact opening mechanism by a manually operable lever.

The electric motor may be operable to open the contacts, e.g. by triggering the contact opening mechanism into opening the contacts. Thus, the electric motor may permit the MCB to be operated as an on/off switch.

The electric motor may be operable to trigger the contact opening mechanism into opening the contacts independently of the trigger mechanism. This may help to save wear on the trigger mechanism, which may include a component susceptible to wear, such as a latch and/or a spring.

The electric motor may be arranged to open the contacts via the contact opening mechanism if an overcurrent condition occurs. In particular, the electric motor may be arranged to open the contacts if an overload condition occurs. This may be useful if the electric motor opens the contacts too slowly to be effective in a short circuit current condition (e.g. where a trigger mechanism may be used), but can safely open the contacts in an overload condition (where overcurrents are lower).

The electric motor may be operable in a first mode in which a rotatable element (e.g. shaft) of the electric motor rotates in a first direction and a second mode in which the rotatable element rotates in a second direction opposite to the first direction. Thus, the electric motor may be operable in two directions, i.e. clockwise and anticlockwise, rather than in just one direction.

The electric motor may be operable in the first mode to close the contacts. The electric motor may be operable in the second mode to prime the trip mechanism, e.g. by supplying mechanical energy to a mechanical energy store of the trigger mechanism and/or contact opening mechanism as described above. This may help to reduce the load on the motor since the motor need not close the contacts and prime the trip mechanism at the same time. Preferably, the electric motor is operable to prime the trip mechanism by supplying mechanical energy to the mechanical energy store of a trigger mechanism in the second mode, since the mechanical energy store of the trigger mechanism may require a large amount of mechanical energy to be primed e.g. if it is to store enough mechanical energy to mechanically assist in the opening of the contacts as described in connection with the third aspect of the invention. The electric motor may be operable in the second mode to open the contacts e.g. via the contact opening mechanism as described above.

The contact closing mechanism may include a cam or a plurality of cams. The electric motor may be operable to close the contacts via the cam(s). This arrangement has been found to be advantageous since cams have been found to be less sensitive to the detrimental effects of debris that is typically be produced within MCBs during short circuit conditions due to arcing between the contacts than other types of coupling elements (such as gear cogs). Such debris could hinder the performance of the MCB if it interfered with the contact closing mechanism.

The electric motor may be a DC motor. The electric motor may be a gear motor. DC motors and in particular, DC gear motors tend to have a large torque:size ratio. Therefore these motors are particularly suited for use in an MCB where space may be extremely limited.

The electric motor may have a rated voltage of 24V or less, 12V or less, or 6V or less, since current may be limited e.g. if the electric motor is operated by the control unit.

The electric motor may be operable to produce a torque of 30 mNm or more, 40 mNm or more or 50 mNm or more. It has been found that such torques are particularly suitable for closing the contacts of an MCB and also for providing other functions such as priming the trip mechanism. If a DC gear motor is used then the DC gear motor may have a reduction ratio of 100:1 or more, 200:1 or more, or 300:1 or more, since these reduction ratios have been found to be useful in producing these torques.

The MCB may have a trigger mechanism as described in connection with the third aspect of the invention. The electric motor may operable to prime the trigger mechanism by supplying mechanical energy thereto, e.g. to the mechanical energy store of the force transfer mechanism described in connection with the third aspect of the invention.

The MCB may have a contact closing mechanism as described in connection with the fourth aspect of the invention. The electric motor may therefore act as the "closing actuator" described in connection with the fourth aspect of the invention.

At its most general, a third aspect of the invention provides an MCB having a trip mechanism including a force transfer mechanism arranged to transform a first trigger force produced by an electromechanical actuator into a second trigger force larger than the first trigger force to trigger a contact opening mechanism into opening the contacts of an MCB. The first trigger force may arise from an overcurrent condition occurring in the MCB.

The third aspect of the invention is therefore concerned with amplifying a trigger force produced by an electromechanical actuator so as to trigger a contact opening mechanism into opening the contacts of an MCB. The amplified trigger force may help to mechanically assist in the opening of the contacts by the contact opening mechanism and/or speed up the opening of the contacts by the contact opening mechanism.

The third aspect of the invention may therefore provide an MCB having:

a pair of openable contacts located in a main current path between a line terminal and a load terminal; and a trip mechanism including a trigger mechanism and a contact opening mechanism for opening the contacts if an overcurrent condition occurs, the trigger mechanism including:

an electromechanical actuator arranged to be operated by a trip current to produce a first trigger force;

a force transfer mechanism arranged to transform the first trigger force into a second trigger force larger than the first trigger force;

wherein the force transfer mechanism couples the electromechanical actuator to the contact opening mechanism such that the second trigger force triggers the contact opening mechanism into opening the contacts.

The force transfer mechanism may couple the electromechanical actuator to the contact opening mechanism such that the second trigger force mechanically assists in the opening of the contacts by the contact opening mechanism, i.e. in addition to triggering the contact opening mechanism. The contact opening mechanism should be capable of opening the contacts by itself. Therefore, the mechanical assistance by the second trigger force should supplement, rather than replace, the opening of the contacts by the contact opening mechanism.

Mechanical assistance in the opening of the contacts by the second trigger force may help to reduce the time taken for the contact opening mechanism to open the contacts. In addition, mechanical assistance by the second trigger force may help to prevent the contacts from welding together in the event of a very large short circuit overcurrent, i.e. "tack" welding which can happen at very large overcurrents, e.g. 1000 A to 2000 A.

The force transfer mechanism may include a trigger member which is arranged to be moved by the second trigger force to trigger the contact opening mechanism into opening the contacts. Therefore, transforming the first trigger force into a larger second trigger force may reduce the time taken for the contact opening mechanism to be triggered as the trigger member may be moved at higher speed than if it were moved by the (smaller) first trigger force.

The trigger member may trigger the contact opening mechanism by moving into contact with the contact opening mechanism. Preferably, the trigger member triggers the contact opening mechanism by striking the contact opening mechanism, e.g. by striking a trip lever of the contact opening mechanism. A striking action has been found to be particularly useful in preventing "tack" welding if the trigger member is arranged to mechanically assist the opening of the contacts. However, the trigger member may trigger the contact opening mechanism indirectly, i.e. via one or more other members, so that the trigger member does not contact the contact opening mechanism directly.

The trigger member may be arranged to be moved by the second trigger force to mechanically assist in the opening of the contacts by the contact opening mechanism. The trigger member may be arranged to mechanically assist in the opening of the contacts by transferring momentum to a movable one of the contacts (from the trigger member). The transfer of momentum may be direct e.g. by the trigger member directly contacting a movable one of the contacts, or indirect e.g. by the trigger member contacting one or more other members which then contact the movable one of the contacts. For example, momentum may be transferred from the trigger member to a movable one of the contacts by the trigger member moving into contact with a trip lever which then moves into contact with a movable one of the contacts.

The trigger member may be movably mounted in the MCB. For example, the trigger member may be slidably mounted or pivotally mounted in the MCB, e.g. to the MCB housing. The trip member may, for example, be a pin slidably mounted in the MCB (e.g. like the "trip pin" described in more detail below) or a lever pivotally mounted in the MCB (e.g. like the "spring reset lever" described in more detail below).

The contact opening mechanism may be any suitable mechanism which is capable of opening the contacts if triggered. The contact opening mechanism may resemble the contact opening mechanism of a conventional MCB.

Thus, the contact opening mechanism may include a mechanical energy store, e.g. a spring or plural springs, arranged to release stored mechanical energy to open the contacts if the contact opening mechanism is triggered. The contact opening mechanism may include a latch, e.g. a mechanical latch, arranged such that the mechanical energy store releases stored mechanical energy to open the contacts if the latch is released. Thus, the force transfer mechanism may couple the electromechanical actuator to the contact opening mechanism such that the second trigger force triggers the contact opening mechanism by releasing the latch. The latch may be released by movement of a trip lever, for example.

The force transfer mechanism may be any suitable mechanism for transforming a first trigger force into a larger second trigger force. The force amplification mechanism may be arranged to transform the actuation force indirectly, i.e. by producing the second trigger force rather than by directly converting/amplifying the first trigger force into the second trigger force.

The force transfer mechanism may include a mechanical energy store, e.g. a spring or plural springs, arranged to release stored energy to produce the second trigger force if the first trigger force is produced. A mechanical energy store is preferable for producing the second trigger force, since mechanical energy stores are well suited to releasing a large amount of energy quickly to produce a large force. The force transfer mechanism may include a latch, e.g. a mechanical latch, arranged such that the mechanical energy store releases stored mechanical energy to produce the second trigger force if the latch is released. Thus, the force transfer mechanism may be arranged such that the first trigger force releases the latch, i.e. causes the latch to be released. The latch may be released by movement of a lever, e.g. a spring release lever as described below.

The electromechanical actuator may include a solenoid. A solenoid typically comprises a coil and an armature. The coil may be arranged to be operated by the trip current into producing the first trigger force to act on the armature if the trip current is produced. Thus, the actuation force may be arranged to move the solenoid if the trip current is produced.

Preferably, the electromechanical actuator includes a magnetically latchable solenoid actuator. The magnetically latchable solenoid actuator may include:

a coil arranged to be operated by the trip current into producing a first force to act on an armature if the trip current is produced;

a spring which is arranged to produce a spring force to act on the armature;

a permanent magnet arranged to produce a retaining force to acts on the armature to at least balance the spring force;

the actuator being arranged such that the first force causes the spring force to overcome the retaining force such that the spring produces a second force to act on the armature. Thus, the permanent magnet acts as a magnetic latch for the magnetically latchable solenoid actuator, the latch being released by the force provided by the coil.

In this context, a "permanent" magnet is intended to mean a magnet which produces a magnetic field in the absence of an applied magnetic field. The permanent magnet may include a rare earth magnet, i.e. a magnet including an alloy of a rare earth element, since rare earth magnets are particularly strong. The permanent magnet may include a magnet plate, e.g. as described in more detail below.

The magnetically latchable solenoid actuator may be provided with a frame for housing the coil, armature, spring and permanent magnet.

A magnetically latchable solenoid actuator is preferable as an electromechanical actuator, as it is well suited to producing a large mechanical force with respect to the current supplied thereto, due to force amplification by the spring. This may be especially useful where the trip current supplied to the electromechanical actuator is a current produced by a control unit, since the current supplied by the control unit may be small compared to the current in the main current path (see below). Thus, the second force produced by the magnetically latchable solenoid actuator may act as the "first trigger force" of the MCB.

However, because the magnetically latchable solenoid actuator amplifies the first force into a second force larger than the first force, the spring and permanent magnet may act as the "force transfer mechanism" of the MCB. In this case, the coil and armature act as the "electromechanical actuator" of the MCB, with the first force acting as the "first trigger force" and the second force acting as the "second trigger force" of the MCB.

The trip current which actuates the electromechanical actuator could be an overcurrent in the main current path. Therefore, the electromechanical actuator could be a solenoid whose coil is located in the main current path, as in a conventional MCB.

However, the inventors have found the third aspect of the invention is particularly useful where the trip current is not a current supplied directly from the main current path, e.g. where the trip current is produced by a control unit as described with reference to the first aspect of the invention. This is because a trip current which is not supplied directly from the main current path may be much smaller than the current in the main current path, in which case the force produced by the electromechanical actuator may be much smaller than if the trip current were supplied directly from the main current path. If the force produced by the electromechanical actuator were used to trigger the contact opening mechanism without the force transfer mechanism, the time taken to open the contacts may increase, or the force produced by the electromechanical actuator may not be large enough to mechanically assist in the opening of the contacts by the contact opening mechanism as described above.

Therefore, the force amplification provided by the force transfer mechanism may allow the control unit to operate the trigger mechanism to open the contacts with a force which is comparable to the force produced by the solenoid of a conventional MCB in the event of a very large overcurrent, even if the trip current produced by the control unit is weak. This may, for example, help the second trigger force to mechanically assist in the opening of the contacts, e.g. to avoid "tack" welding as described above.

The trip mechanism may therefore include: a current sensor arranged to detect current through the main current path; and a control unit arranged to produce the trip current to operate the electromechanical actuator if it determines that an overcurrent condition occurs based on an output of the current sensor. Thus, the trip current is produced by a control unit, rather than being supplied directly from the main current path. The current sensor and control unit may be as described in connection with the first aspect on the invention.

The MCB may include an electric motor and a contact closing mechanism as described in connection with the second aspect of the invention and/or a closing actuator and contact closing mechanism as described in connection with the fourth aspect of the invention.

At its most general, a fourth aspect of the invention provides an MCB having a contact closing mechanism including a mechanical energy store arranged to accumulate mechanical energy from a closing actuator operable to close the contacts of the MCB, the mechanical energy store being further arranged to release the accumulated mechanical energy to close the contacts of the MCB. Thus, the mechanical energy store may help to close the contacts more quickly, e.g. by releasing accumulated mechanical energy over a period of time shorter than the time taken to accumulate the energy. Closing the contacts at a faster speed helps to reduce the likelihood of electrical arcs being created and/or to reduce the severity of such arcs.

The fourth aspect of the invention may therefore provide an MCB having:

a pair of openable contacts located in a main current path between a line terminal and a load terminal;

a trip mechanism for opening the contacts if an overcurrent condition occurs; and a closing actuator operable to close the contacts via a contact closing mechanism;

wherein the contact closing mechanism includes a mechanical energy store arranged to accumulate mechanical energy from operation of the closing actuator and subsequently to release accumulated mechanical energy to close the contacts.

The mechanical energy store may be arranged to release a predetermined amount of accumulated mechanical energy to close the contacts. Thus, the amount of accumulated mechanical energy released by the mechanical energy store of the contact closing mechanism can be selected to be an amount to close the contacts at a desired speed, irrespective of the rate at which energy is supplied to the mechanical energy store by the closing actuator. This is particularly useful if the closing actuator only produces mechanical energy to close the contacts at a very slow rate.

The accumulated mechanical energy released by the mechanical energy store need not be all the mechanical energy accumulated from operation of the closing actuator because, for example, the mechanical energy store may be arranged to use some of the accumulated mechanical energy to act on a movable contact to produce contact pressure after closure of the contacts.

The contact closing mechanism may be arranged such that the rate at which mechanical energy is released by the mechanical energy store is higher than the rate at which energy is accumulated by the mechanical energy store. Similarly, the mechanical energy store may be arranged to release mechanical energy over a period of time shorter than the time taken for the mechanical energy store to accumulate mechanical energy from operation of the closing actuator. Thus, the mechanical energy store is able to close the contacts faster than if the mechanical energy from the closing actuator were used directly to close the contacts.

The closing actuator may be a manually operable actuator, e.g. as used in a conventional MCB. However, the closing actuator is preferably an electric actuator operable to close the contacts, such as an electric motor. The electric actuator and closing mechanism may therefore be as described in connection with the second aspect of the invention. The inventors have found that the mechanical energy store can be particularly useful if the closing actuator is an electrical actuator, since fast closure of the contacts can be achieved, even in those circumstances where the electric actuator produces mechanical energy at a slow rate.

The contact closing mechanism may include an obstruction member movable to obstruct closure of the contacts. The mechanical energy store may be arranged to accumulate mechanical energy from operation of the closing actuator if the obstruction member obstructs the contacts. The mechanical energy store may be arranged to release accumulated mechanical energy if the obstruction member is moved out of the obstruct position. The contact closing mechanism may be arranged such that the position of the obstruction member depends on the amount by which the closing actuator has actuated, e.g. the amount by which a motor has turned if the closing actuator is a motor.

The contact closing mechanism may be arranged to move the obstruction member out of the obstruct position such that a predetermined amount of mechanical energy is released by the mechanical energy store.

The contact closing mechanism may be arranged such that the amount of mechanical energy stored in the mechanical energy store is dependent on the amount by which the closing actuator has been actuated. Thus, the contact closing mechanism could be arranged to move the obstruction member out of the obstruct position such that a predetermined amount of mechanical energy is released by moving the obstruction member out of the obstruct position if the closing actuator has actuated by a predetermined amount.

The contact closing mechanism may include a biasing member which biases the obstruction member to obstruct the contacts. Thus, the obstruction member will obstruct the contacts unless it is moved out of the obstruct position, e.g. by another part of the contact closing mechanism.

The biasing member may be arranged to act on the obstruction member with a biasing force that reduces as the mechanical energy store accumulates mechanical energy. Thus, it becomes easier to move the obstruction member out of the obstruct position as the amount of accumulated energy increases. This may reduce the load on the closing actuator if the contact closing mechanism is arranged to move the obstruction member out of the obstruct position if the mechanical energy stored in the mechanical energy store exceeds a predetermined amount.

The mechanical energy store may be arranged to release accumulated mechanical energy to close the contacts by producing a force which acts on a movable one of the contacts. The force on the movable contact will depend on the rate at which accumulated mechanical energy is released by the mechanical energy store and may therefore be increased by releasing mechanical energy at a faster rate, e.g. so as to decrease the time taken for the contacts to close.

The movable one of the contacts may be rotatably mounted about a pivot. The movable contact may include an elongate aperture (e.g. oval-shaped) with the pivot passing through the elongate aperture. The elongate aperture may thus accommodate translational movement of the movable contact which may, for example, be useful for allowing the mechanical energy to be accumulated if rotational movement of the movable contact is obstructed by the obstruction member.

The mechanical energy store may include a first spring arranged to accumulate mechanical energy from operation of the closing actuator. A spring is well suited as part of the mechanical energy store because a spring is typically able to release energy quickly, and therefore close the contacts quickly. The first spring may be a compression spring.

The mechanical energy store may include a second spring arranged to accumulate mechanical energy from operation of the closing actuator. Having two springs has been found to be useful in configuring the mechanical energy store to close the contacts at a desired speed. The second spring may be a torsion spring. Moreover, having two springs allows profiling of the springs so that the load on the closing actuator can be configured to match the requirements of the closing actuator (e.g. to match the torque requirements of a closing actuator).

The mechanical energy store may be part of a contact opening mechanism, i.e. in addition to being part of the contact closing mechanism. The mechanical energy store may therefore be arranged to release a portion of the accumulated mechanical energy to open the contacts if contact opening mechanism is triggered (after a portion of the accumulated mechanical energy has been used to close the contacts). The contact opening mechanism which includes the mechanical energy store may be as described in connection with the other aspects of the invention.

The invention includes any combination of the aspects and preferred features described herein except where such a combination is clearly impermissible or expressly avoided.

The contact opening/closing mechanism(s), trip mechanism(s) and force amplification mechanism(s) disclosed herein are not intended to be limited to any one type of mechanism. Such mechanisms may be of any suitable design to carry out the functions described herein, as would be apparent to a skilled person. Such mechanisms may typically comprise one or more operably connectable components such as movable members, levers, springs and/or actuators. As should be apparent from the description herein, these mechanisms may share components.

Embodiments of our proposals are discussed below, with reference to the accompanying drawings in which.

Figure 1:
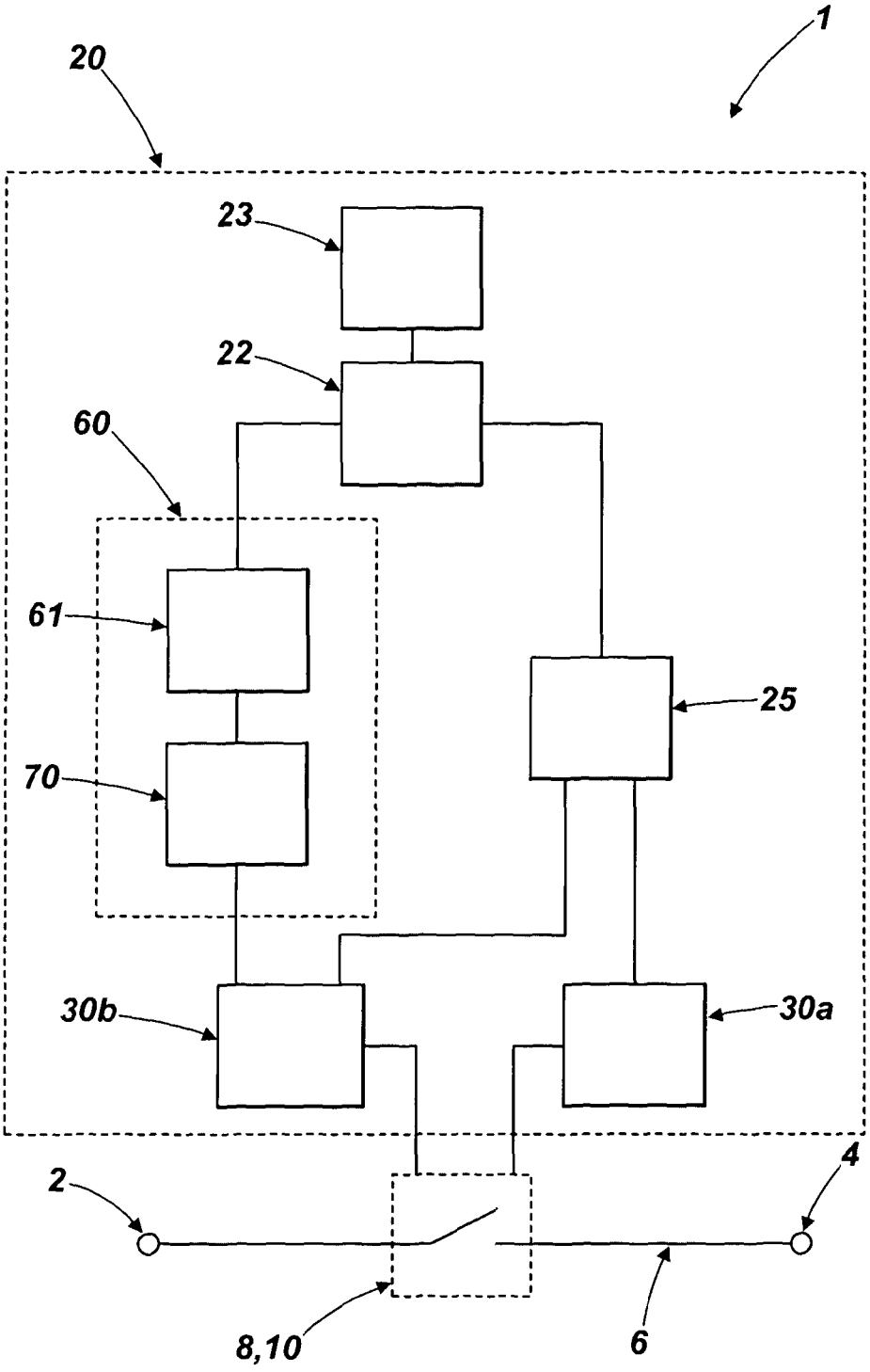
FIG. 1 is a symbolic diagram of a first MCB.

FIG. 1 shows a first MCB 1 which has a first terminal 2 and a second terminal 4 which define a main current path 6 therebetween. A pair of openable contacts 8, 10 are located in the main current path 6.

The first MCB 1 includes a trip mechanism 20 for opening the contacts 8, 10 if an overcurrent condition occurs. The trip mechanism 20 includes a control unit 22, a current sensor 23, a motor 25, a contact closing mechanism 30*a*, a contact opening mechanism 30*b* and a trigger mechanism 60.

The control unit 22 is arranged to operate the motor 25 to close the contacts 8, 10 via the contact closing mechanism 30*a*. The control unit is also arranged to operate the motor 25 to open the contacts 8, 10 via the contact opening mechanism 30*b*. In addition, the control unit 22 can also operate the motor to prime the trip mechanism 20 by supplying mechanical energy to the contact opening mechanism 30*b* and to the trigger mechanism 60, as described in more detail below.

The control unit 22 is arranged to determine whether an overcurrent condition occurs based on an output of the current sensor 23 which detects current through the main current path 6. In this particular embodiment, the current sensor 23 is a current transducer which outputs a current to the control unit 22, the outputted current being representative of the current in the main current path 6. Current sensors are well known and are not discussed in further detail.

The control unit 22 includes a capacitor (not shown) and is arranged to produce a trip current (from the capacitor) if it determines that a short circuit condition exists based on an output of the current sensor 23. The trigger mechanism 60 is operated by the trip current to trigger the contact opening mechanism 30*b* into opening the contacts 8, 10.

The control unit 22 is further arranged to operate the motor 25 to trigger the contact opening mechanism 30*b* into opening the contacts 8, 10 if it determines that an overload condition exists based on an output of the current sensor 23. Thus, the contact opening mechanism 30*b* is triggered independently of the trigger mechanism 60 if an overload condition occurs. This helps to avoid wear on the trigger mechanism 60 in the event of an overload condition, where the time taken to open the contacts is less important than for short circuit conditions.

As shown in FIG. 1, the trigger mechanism 60 includes an electromechanical actuator 61 and a force transfer mechanism 70. The electromechanical actuator 61 is arranged to be operated by the trip current from the control unit 22 so as to produce a first trigger force. The force transform mechanism 70 is arranged to produce a second trigger force larger than the first trigger force if the first trigger force is produced. Thus, the force transfer mechanism 70 transforms the first trigger force into the second trigger force. The force transfer mechanism 70 couples the electromechanical actuator 61 to the contact opening mechanism 30*b* such that the second trigger force triggers the contact opening mechanism 30*b* into opening the contacts 8, 10. The second trigger force also helps to mechanically assist the opening of the contacts 8, 10 by the contact opening mechanism 30*b*, which helps to avoid "tack" welding of the contacts 8, 10 during large short circuit overcurrents, as described in more detail below.

FIGS. 2 to 8 show the first MCB 1 in more detail.

Figure 2:
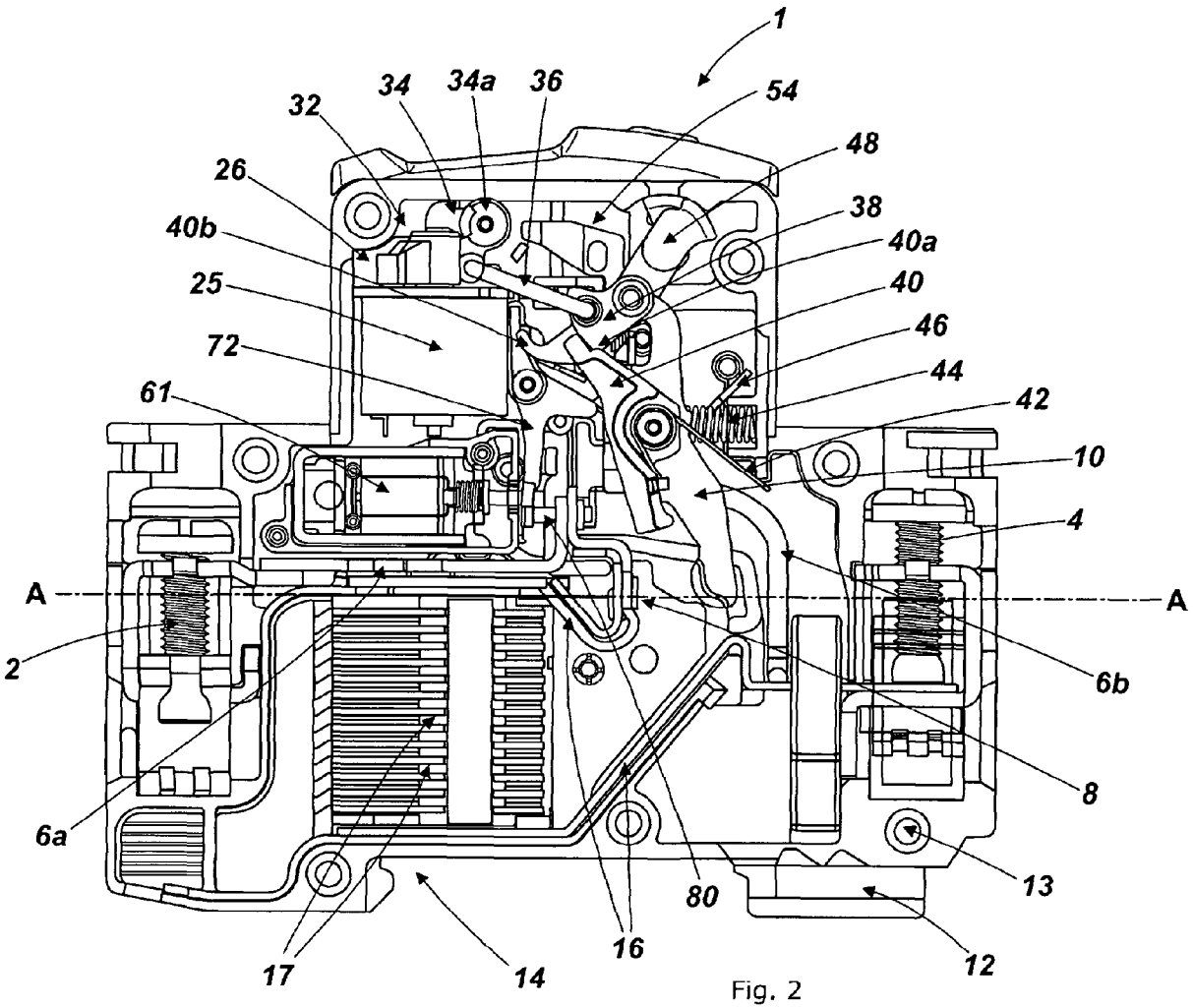
FIG. 2 is a cut-away plan view of the first MCB in a "primed" state.
Figure 3:
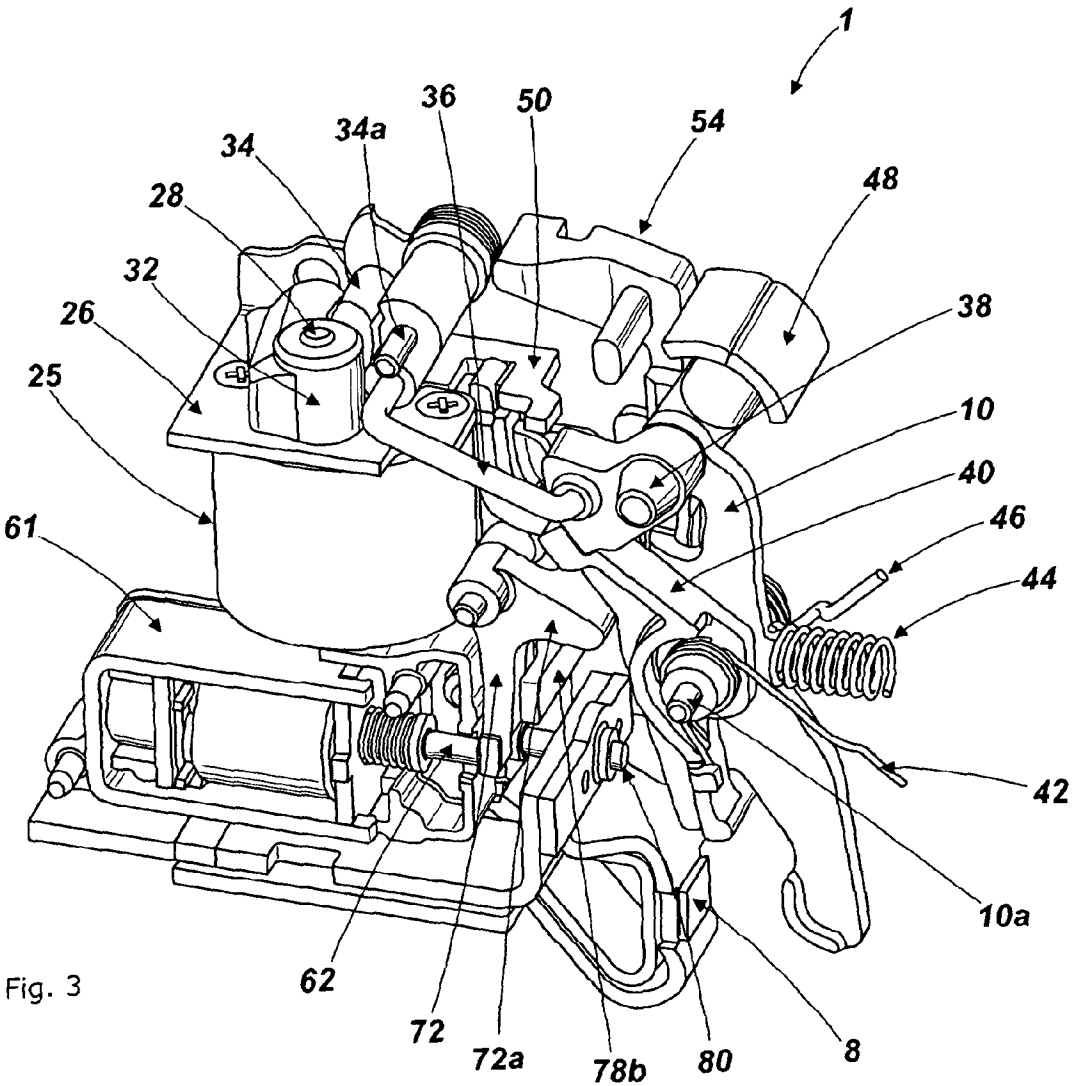
FIG. 3 is a cut-away perspective view of the first MCB in the "primed" state.

The first MCB 1 shall now be described in a "primed" state as shown in FIGS. 2 and 3. "Clockwise" and "anticlockwise" are herein defined as viewed in FIG. 2 unless otherwise stated.

The first MCB 1 includes a plastic housing 12. The housing 12 is provided in two halves (one half of the housing 12 is not shown in the drawings) which are riveted together via rivet holes 13. An outer surface of the housing 12 defines a mounting recess 14 for mounting the MCB on a mounting rail typically found on a domestic breaker panel and the like.

The first terminal 2 and second terminal 4 of the first MCB 1 are provided as screw terminals at opposite ends of the housing 12. In this embodiment, the first terminal 2 is a load terminal for connection to a load to be powered by a power supply and the second terminal 4 is a line terminal for connection to the power supply. However, in other embodiments, the first terminal 2 is the line terminal and the second terminal 4 is the load terminal. In either case, the main current path is part of the current path between the power supply and the load.

The fixed contact 8 is provided as a strip of conductor mounted within the housing 12. The movable contact 10 is provided as an arm, rotatably mounted to the housing by a movable contact pivot 10*a* via an elongate slot 11 (see FIG. 5) in the movable contact 10. The elongate slot 11 accommodates translational movement of the movable contact 10 relative to the pivot 10*a*. In this embodiment, the movable contact 10 includes an integral contact pad, e.g. of silver plated copper, for contacting the fixed contact 8. In other embodiments, the movable contact 10 has a conductor pad mounted thereto.

The fixed contact 8 is connected to the first terminal 2 by a tortuous conductor path 6*a*. The movable contact 10 is connected to the load terminal by a tortuous conductor path 6*b*. The tortuous conductor paths 6*a*, 6*b* thus form the main current path 6 of the MCB in which the contacts 8, 10 are located.

The contacts 8, 10 can be closed by rotating the movable contact 10 clockwise towards the fixed contact 8, and opened by rotating the movable contact 10 anticlockwise away from the fixed contact 8. When the contacts 8, 10 are closed, current can flow through the main current path 6. When the contacts 8, 10 are open, current cannot flow through the main current path 6.

The first MCB 1 includes arc runners 16 and arc extinguishing plates 17. The arc runners 16 are connected to the first and second terminals 2, 4 and extend into an arc extinguishing chamber of the housing 12 in which the arc extinguishing plates 17 are located. In the event of a short circuit condition, very large short circuit overcurrents may flow through the main current path 6 to produce an arc between the contacts 8, 10 as the contacts 8, 10 are opened by the contact opening mechanism 30*b*. The arc runners 16 transfer such an arc to the arc extinguishing plates 17 act so as to extinguish the arc. The arc runners 16, arc extinguishing plates 17 and other components of the MCB 1 located below the line A-A in FIG. 2 are well known and shall not be described in further detail.

The motor 25 is mounted in the housing 12 by a motor mounting plate 26 (see FIG. 3). The motor 25 has a shaft 28 (see FIG. 3) on which a first cam 32 is mounted. The motor 25 is operable in a "forward" mode in which the shaft 28 of the motor 25 rotates in a clockwise direction and also in a "reverse" mode in which the shaft of the motor 25 rotates in an anticlockwise direction as viewed from the end of the motor 25 to which the first cam 32 is mounted.

In some embodiments, the motor 25 is a 6V DC gear motor having a reduction ratio of 324:1 and an output torque of 50 mNm during intermittent operation. Such motors are available from the Faulhaber Group, for example. Other motors may be equally suitable.

The contact closing mechanism 30*a* includes the first cam 32, a second cam 34, a second cam spring 35, a link 36, a latch 38, a trip lever 40, a trip lever spring 42, movable contact springs 44, 46, a slider 50, a slider lever 52, an obstruction member 54 and an obstruction member spring 56.

The contact opening mechanism 30*b* shares many components with the contact closing mechanism 30*a* and includes the second cam 34, the second cam spring 35, the link 36, the latch 38, the trip lever 40, the trip lever spring 42, and the movable contact springs 44, 46.

The first cam 32 is mounted to the shaft 28 of the motor 25 such that rotation of the shaft 28 causes the first cam 32 to rotate in the same direction as the shaft 28. Thus, operation of the motor 25 the forward mode causes the first cam 32 to rotate in a clockwise direction and operation of the motor 25 in the "reverse" mode causes the first cam 32 to rotate in an anticlockwise direction as viewed from the end of the motor 25 to which the first cam 32 is mounted.

Figure 4:
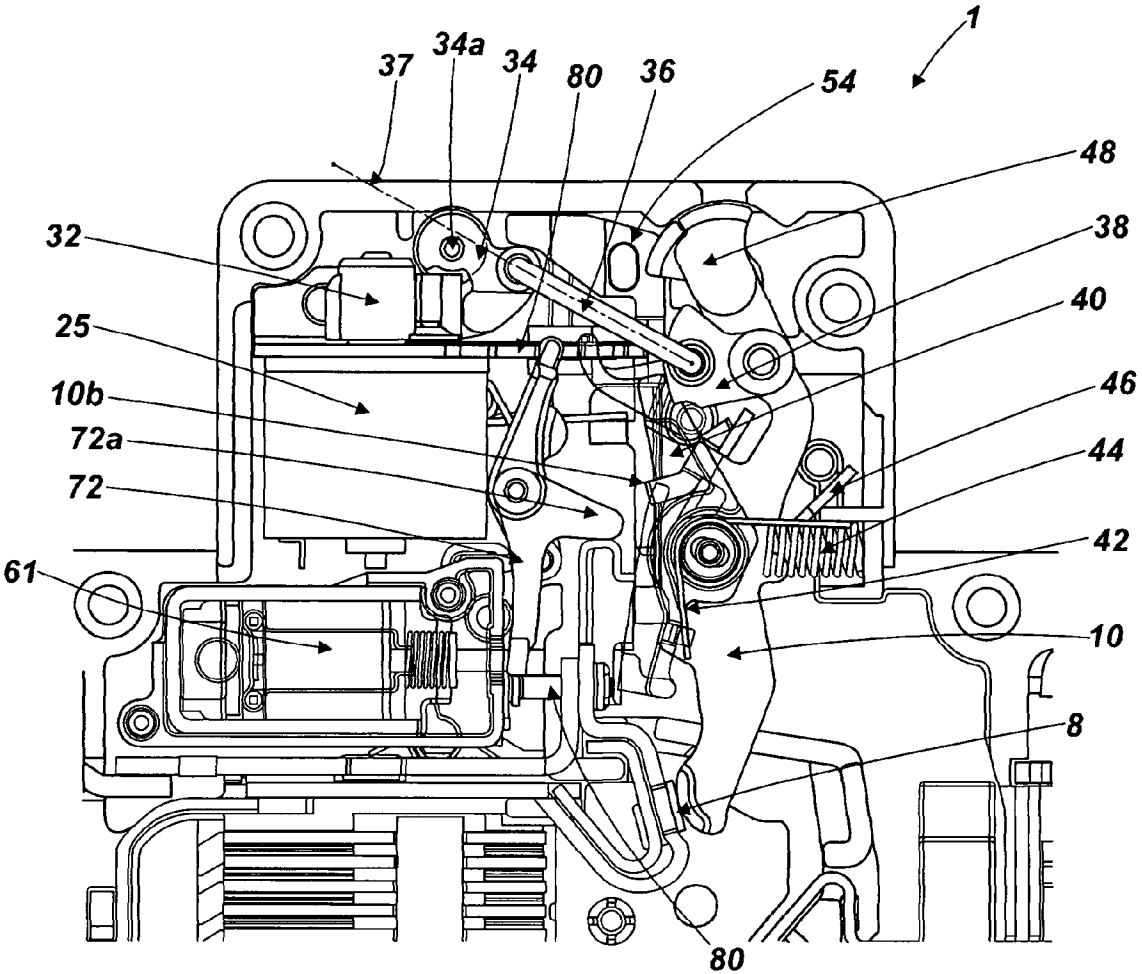
FIG. 4 is a cut-away plan view of the first MCB in an "on" state in which a trip lever is illustrated to be semi-transparent.

The second cam 34 is rotatably mounted to the housing 12 by a pivot 34*a* to rotate between a "retracted" position shown in FIG. 2 and an "extended" position shown in FIG. 4. The second cam 34 is positioned such that operation of the motor 25 in the forwards mode causes the first cam 32 to engage the second cam 34 so as to make the second cam 34 rotate in an anticlockwise direction towards its extended position. The second cam spring 35 (see FIG. 5), which is a torsion spring, biases the second cam 34 towards its retracted position.

The link 36 connects the second cam 34 to the latch 38 such that rotation of the second cam 34 towards its extended position pushes the latch 38 away from the motor 25. The latch 38 is rotatably mounted to the movable contact 10 by a pivot 38*a* on the movable contact 10 such that the latch 38 can rotate relative to the movable contact 10.

The trip lever 40 is rotatably mounted to the movable contact pivot 10*a*, i.e. the pivot to which the movable contact pivot 10 is rotatably mounted. The trip lever spring 42, which is a torsion spring, biases the trip lever 40 in a clockwise direction such that, in the "primed" state shown in FIGS. 2 and 3, the trip lever 40 engages the latch 38 so as to hold the latch 38 in a recess 40*a* in the trip lever 40. This prevents the latch 38 from freely rotating about the latch pivot 38*a*. Because the latch 38 is held in the recess 40*a* in the trip lever 40, rotation of the second cam 34 towards its extended position pushes the latch 38 (via the link 36) against the movable contact 10, which causes the movable contact 10 to rotate in a clockwise direction, i.e. towards the fixed contact 8.

The movable contact springs 44, 46 include a movable contact compression spring 44 and a movable contact torsion spring 46 mounted in the housing 12. When the first MCB 1 is in the "primed" state shown in FIGS. 2 and 3, both of the movable contact springs 44, 46 provide a force which biases the movable contact 10 away from the fixed contact 8, although the force provided by the movable contact compression spring mainly acts through the movable contact pivot 10*a*.

A positive contact indicator 48 is rotatably mounted to the housing 12 by a pivot and is visible from the outside of the first MCB 1 through a window in the housing 12 (not shown). The indicator 48 includes a U-shaped portion which slidably engages with the latch pivot 38*a* on the movable contact 10 (see FIG. 5). This engagement is such that rotation of the movable contact 10 causes rotation of the indicator 48 to display a first colour (e.g. green) through the window when the contacts 8, 10 are open, and to display a second colour (e.g. red) through the window when the contacts 8, 10 are closed. Thus, the indicator 48 enables a user to determine whether the contacts 8, 10 are open or closed, without having to open the housing 12.

In addition to being engagable with the second cam 34, the first cam 32 is connected (by a locating pin or moulded protrusion) to the slider 50 which is slidably mounted in a channel formed in the motor mounting plate 26. The slider 50 is movable between a "retracted" position shown in FIG. 3 and an "extended" position shown in FIG. 5. The connection between the first cam 32 and the slider 50 is such that operation of the motor 25 in the forward mode causes the slider 50 to move towards its extended position and operation of the motor 25 in the reverse mode causes the slider 50 to move towards its retracted position.

The slider 50 is connected to the slider lever 52 (see FIG. 5) which is rotatably mounted to the housing 12 by a pivot. Movement of the slider 50 towards its extended position causes the slider lever 52 to rotate in an anticlockwise direction as viewed in FIG. 5.

The obstruction member 54 is slidably mounted in a channel formed in the housing 12. The obstruction member 54 is movable into an obstruct position in which it obstructs the movable contact 10 from contacting the fixed contact 8. In the "primed" state shown in FIGS. 2 and 3, the obstruction member 54 in its obstruct position, where it is lowered towards the fixed contact 8 so as to obstruct the movable contact 10. FIG. 4 shows the obstruction member 54 lifted out of its obstruct position.

Figure 5:
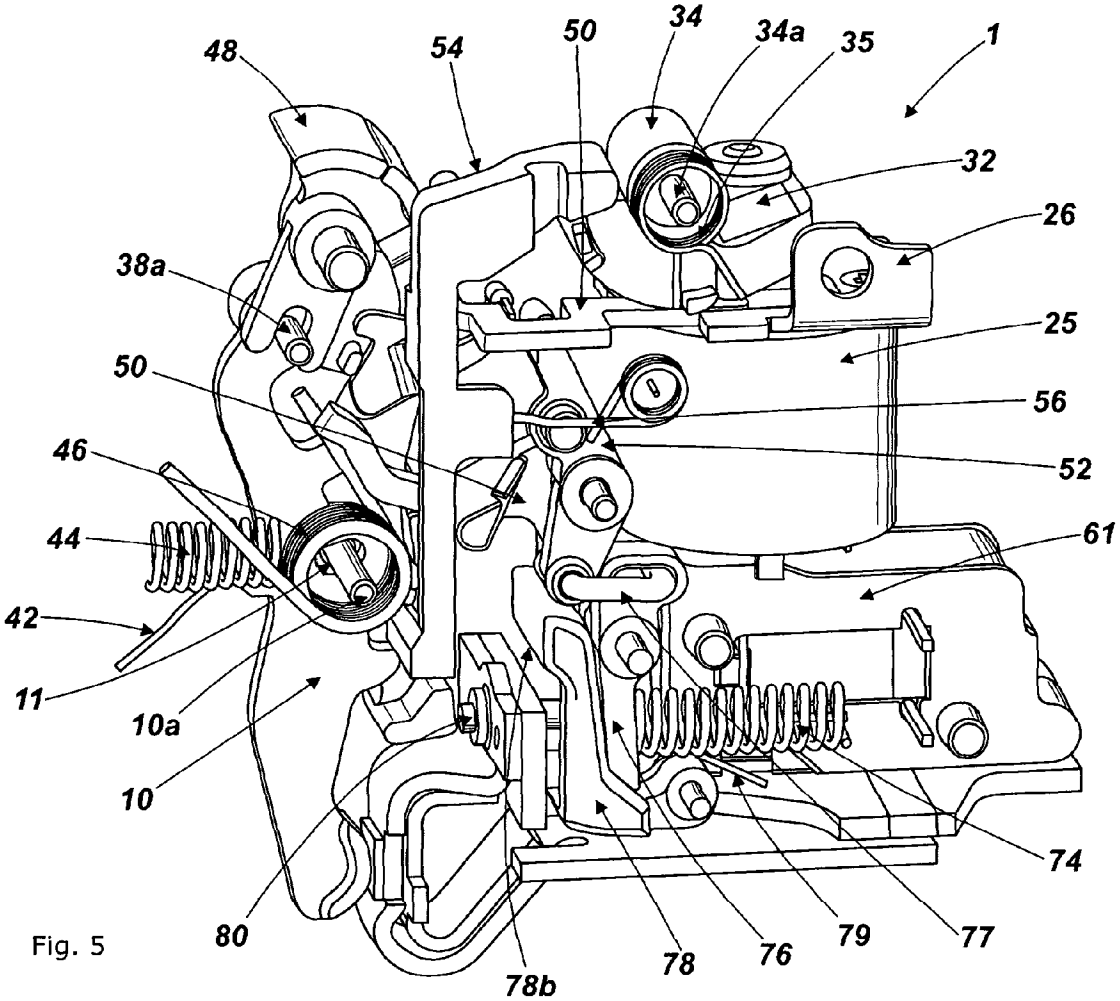
FIG. 5 is another cut-away perspective view of the first MCB in the "on" state, as viewed from an opposite side to that shown in FIG. 4.

The obstruction member spring 56 is mounted on a protrusion in the housing 12 (not shown) and engages with a protrusion on the slider lever 52 (see FIG. 5). The obstruction member spring 56 and biases the obstruction member 54 towards the obstruct position. However, rotation of the second cam 34 towards its extended position (i.e. in an anticlockwise direction) causes the second cam 34 to engage the obstruction member 54 so as to overcome the obstruction member spring 56 thus lifting the obstruction member 54 out of the obstruct position, e.g. as shown in FIG. 5.

The obstruction member spring 56 is arranged to act on the obstruction member 54 with a biasing force that reduces as the motor 25 operates in its forward mode. Thus, the biasing force acting on the obstruction member 54 is reduced before the second cam 34 engages the obstruction member 54 to lift it out of the obstruct position. Thus, the load on the motor 25 due to the obstruction member spring 56 is reduced.

The electromechanical actuator 61 is a magnetically latchable solenoid actuator. As explained above, the electromechanical actuator 61 is arranged to be operated by a trip current produced by the control unit 22. Operation of the electromechanical actuator 61 causes an armature 62 (see FIG. 3) to be pushed outwardly from an aperture in the electromechanical actuator 61. The electromechanical actuator 61 is described in more detail below, with reference to FIG. 8.

The force transfer mechanism 70 includes an actuator reset lever 72, a trip spring 74, a spring reset lever 76, a spring release lever 78, and a trip pin 80.

The actuator reset lever 72 is rotatably mounted to the housing 12 by a pivot and has a portion which overlaps the aperture in the electromechanical actuator 61 such that the armature 62 of the electromechanical actuator 61 hits the actuator reset lever 72 when the electromechanical actuator 61 is operated by the trip current.

The trip spring 74 (see FIG. 5) is a large compression spring held in a cavity (not shown) in the housing 12 and acts as a mechanical energy store for the force transfer mechanism. When the first MCB 1 is in the "primed" state shown in FIGS. 2 and 3, the trip spring 74 is fully compressed and is therefore primed, i.e. storing mechanical energy. The spring reset lever 76 is positioned in front of the trip spring 74 and is rotatably mounted to the housing 12 by a pivot so that the trip spring 74 rotates the spring reset lever 76 in an anti-clockwise direction as viewed in FIG. 7 when the trip spring 74 expands, i.e. as it releases its stored mechanical energy.

The spring release lever 78 is rotatably mounted to the housing 12 by a pivot. In the "primed" state shown in FIGS. 2 and 3, the spring release lever 78 is in a blocking position in which a lip 78*a* (see FIG. 7) of the spring release lever is positioned in front of the spring reset lever 76 so as to prevent the spring reset lever 76 from rotating. Thus, when the first MCB 1 is in the "primed" state, the spring release lever 78 prevents the trip spring 74 from releasing its stored mechanical energy. A release lever spring 79, which is a torsion spring (see FIG. 7), biases the spring release lever 78 to its blocking position.

Figure 7:
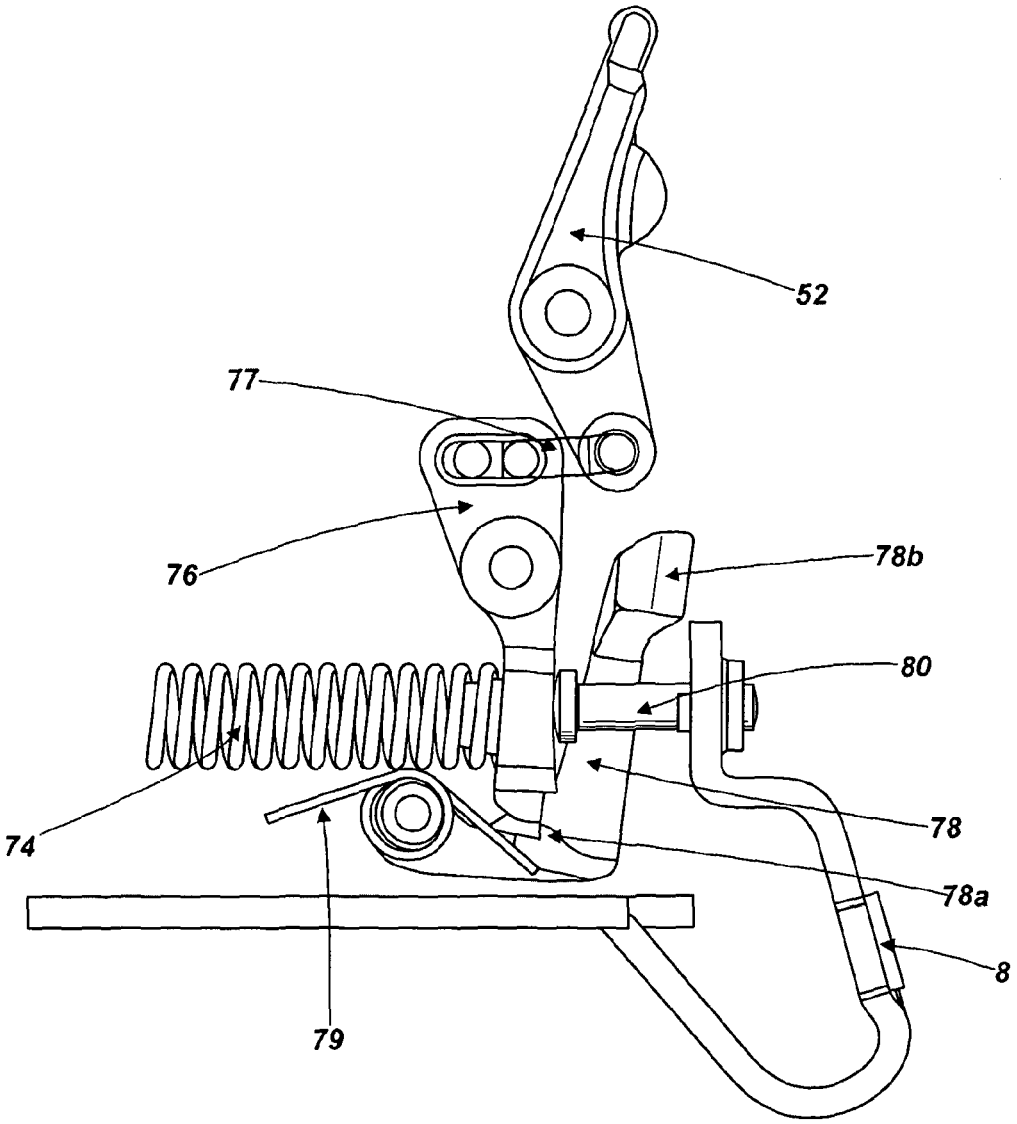
FIG. 7 is a cut-away plan view of part of a force transfer mechanism of the first MCB

A limb 78*b* of the spring release lever 78 extends across the actuator reset lever 72 (see FIG. 3) so that rotational movement of the actuator reset lever 72 caused by operation of the electromechanical actuator 61 causes the actuator reset lever 72 to rotate the spring release lever 78 in a clockwise direction as shown in FIG. 7. This moves the spring release lever 78 out of the blocking position so that the lip 78*a* moves out of the way of the spring reset lever 76 (see FIG. 7) to allow the trip spring 74 to release its stored mechanical energy to trigger the contact opening mechanism 30*b* into opening the contacts 8, 10, as described in more detail below. The spring release lever 78 therefore acts as a latch for the trip spring 74, the latch being released by moving the spring release lever 78 out of its blocking position.

A link 77 connects the spring reset lever 76 to the slider lever 52 (see FIG. 5), via an elongate slot in the spring reset lever 76. The elongate slot in the spring reset lever 76 accommodates movement of the spring reset lever 76 so that the slider lever 52 and slider 50 are not moved during expansion of the trip spring 74.

The trip pin 80 is slidably mounted within a fixed contact backing/current path 6*a* assembly of the housing 12 and is positioned between the spring reset lever 76 and the trip lever 40.

Operation of the motor 25 to close the contacts 8, 10 from the "primed" state shown in FIGS. 2 and 3 shall now be described.

In order to close the contacts 8, 10 from the "primed" state, the control unit 22 operates the motor 25 in its forward mode. This causes the first cam 32 to rotate to engage the second cam 34 so as to make the second cam 34 rotate towards its extended position. As the second cam 34 rotates, it pushes on the movable contact 10 via the link 36 and the latch 38, to rotate the movable contact 10 in a clockwise direction towards the fixed contact 8. During this operation, the link 36 and latch 38 are moved towards the movable contact springs 44, 46. However, the latch 38 is prevented from disengaging from the trip lever 40 by the trip lever spring 42, which biases the trip lever 40 to rotate in a clockwise direction so as to follow the movement of the latch 38 towards the movable contact springs 44, 46.

Although the movable contact 10 initially rotates towards the fixed contact 8, closure of the contacts 8, 10 is prevented by the obstruction member 54 which is biased into its obstruct position by the obstruction member spring 56. The obstruction member 54 thus prevents continued rotational movement of the movable contact 10, but as the second cam 34 continues to push on the movable contact 10 via the link 36 and latch 38, the elongate slot 11 through which the pivot 10*a* extends accommodates translational movement of the movable contact 10 towards the movable contact springs 44, 46.

The movable contact springs 44, 46 are arranged to accumulate mechanical energy from the motor 25 due to rotational and translational movement of the movable contact 10 towards the springs as the latch 38 pushes on the movable contact 10.

As explained above, when the first MCB 1 is in the "primed" state shown in FIGS. 2 and 3, the movable contact springs 44, 46 bias the movable contact away from the fixed contact 8. The biasing by the movable contact springs 44, 46 pushes the latch towards the second cam 34 such that a force from the movable contact springs 44, 46 is transmitted towards the second cam 34 along the axis of the link 36. Thus, when the second cam 34 is in or near its retracted position, the force acting along axis of the link 36 pushes the second cam 34 back towards its retracted position.

However, as the second cam 34 continues to rotate towards its extended position, the force from the movable contact springs 44, 46 which acts along the axis of the link 36 becomes "overcentre" relative to the pivot 34*a* of the second cam 34 and therefore biases the second cam 34 towards its extended position, overcoming the biasing of the second cam 34 by the second cam spring 35. This is illustrated in FIG. 4 where the line of action of the "overcentre" force acting along the axis of the link 36 is indicated with the reference numeral 37.

Once the force acting along the axis of the link 36 has become "overcentre" relative to the second cam pivot 34*a*, the second cam 34, the link 36 and the latch 38 form a support structure which supports the latch pivot 38*a* such that the latch pivot 38*a* becomes the pivot for the movable contact 10 (the elongate slot 11 accommodates rotational movement of the movable contact 10 about the latch pivot 38*a*). Once the pivot for the movable contact 10 has changed to the latch pivot 38*a*, the forces provided by the movable contact springs 44, 46 act to bias the movable contact 10 towards, rather than away from, the fixed contact 8.

As the second cam 34 approaches its extended postion, it engages the obstruction member 54 so as to overcome the obstruction spring 92 and lift the obstruction member 54 out of the obstruct position, e.g. as shown in FIG. 4.

Once the obstruction member 54 has been lifted out of the obstruct position, the movable contact 10 becomes free to move into contact with the fixed contact 8 and so a portion of the accumulated mechanical energy stored in the movable contact springs 44, 46 is released to drive the movable contact 10 towards the fixed contact 8 at a speed that is essentially independent of the speed of operation of the motor 25. The movable contact springs 44, 46 therefore act as a mechanical energy store of the contact closing mechanism 30*b*.

Some accumulated mechanical energy remains in the movable contact springs 44, 46 after closure of the contacts 8, 10 and provides a force which urges the contacts 8, 10 together to provide contact pressure. Thus, the first MCB 1 enters an "on" state as shown in FIGS. 4 and 5.

Operation of the motor 25 to trigger the contact opening mechanism 30*b* (independently of the trigger mechanism 60) into opening the contacts 8, 10 from the "on" state shown in FIGS. 4 and 5 shall now be described.

When the first MCB 1 is in the "on" state, a projection 40*b* on the trip lever 40 is located within a recessed portion of the slider 50. To open the contacts 8, 10 by operation of the motor 25, the control unit 22 operates the motor 25 in its reverse mode, to move the slider 50 a small distance towards its retracted position. This movement of the slider 50 causes the slider 50 to engage with the projection 40*b* so as to rotate the trip lever 40 in an anticlockwise direction.

Rotation of the trip lever 40 in an anticlockwise direction causes the latch 38 to disengage from the trip lever 40 and therefore releases the latch 38. Once the latch 38 has been released, the support structure (formed by the second cam 34, the link 36 and the latch 38) which supported the latch pivot 38*a* collapses and the movable contact pivot 10*a* again becomes the pivot for the movable contact 10.

Once the movable contact pivot 10*a* has become the pivot for the movable contact 10, the movable contact springs 44, 46 again bias the movable contact 10 away from the fixed contacts. As explained above, some accumulated mechanical energy remains in the movable contact springs 44, 46 after closure of the contacts 8, 10. Once the movable contact pivot 10*a* has become the pivot for the movable contact 10, this remaining accumulated mechanical energy is released by the movable contact springs 44, 46 so as to open the contacts 8, 10 by rotating the movable contact 10 away from the fixed contact 8.

The movable contact springs 44, 46 therefore act as a mechanical energy store for the contact opening mechanism 30*b* which releases stored mechanical energy to open the contacts 8, 10. The mechanical energy used by the movable contact springs 44, 46 to open the contacts 8, 10 was supplied by the motor 25 during the operation to close the contacts 8, 10 described above.

As the contacts 8, 10 are opened, any resulting arc between the contacts 8, 10 is transferred by the arc runner 17 to the extinguishing plates 17 where it is extinguished.

As the movable contact 12 rotates in an anticlockwise direction towards a fully open position, a projection 10*b* (see FIG. 4) on the movable contact engages a projection 72*a* (see FIG. 3) on the actuator reset lever 72 to rotate the actuator reset lever 72 in a clockwise direction. This pushes the armature 62 back into the aperture of the electromechanical actuator 61, so as to reset the electromechanical actuator 61.

Figure 6:
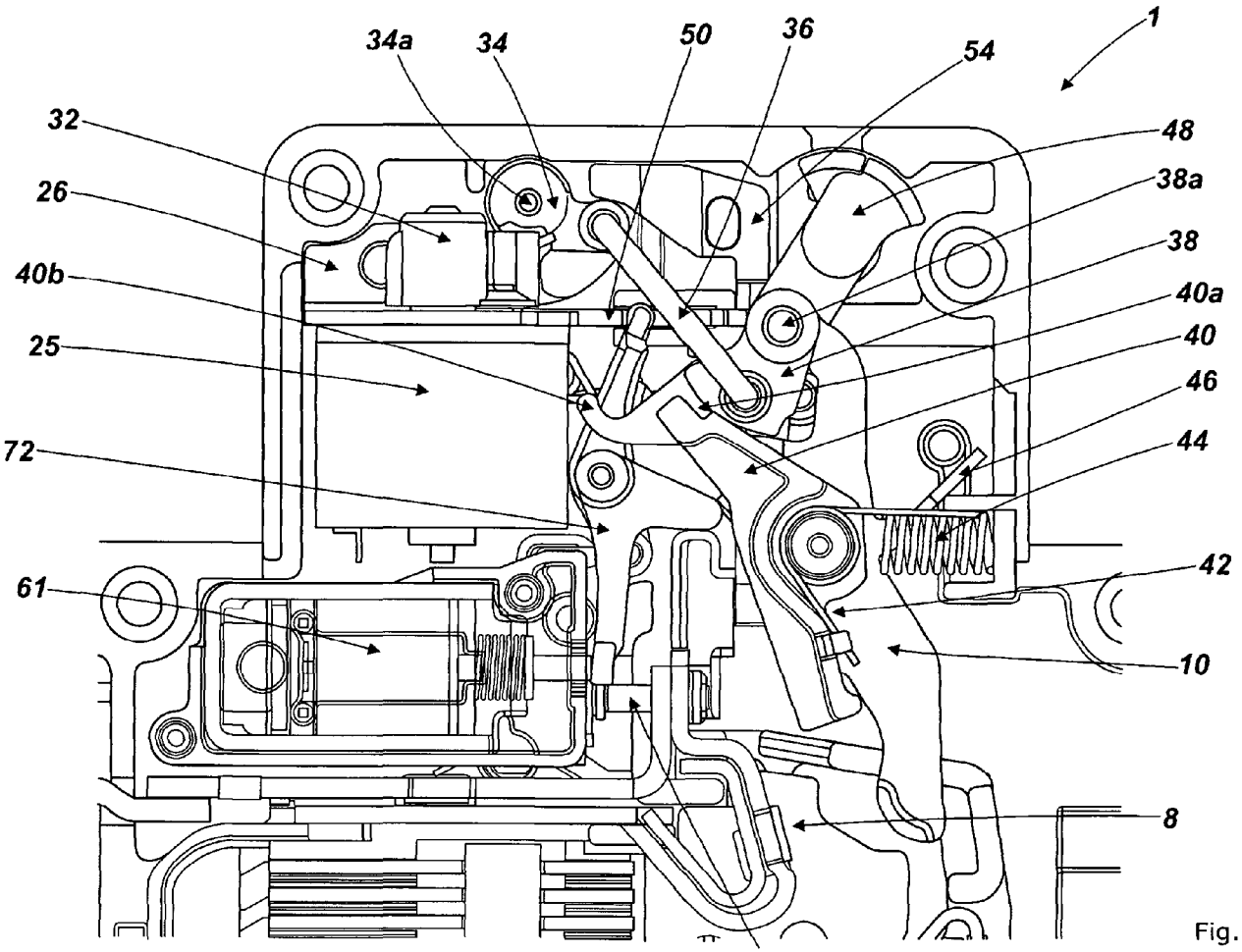
FIG. 6 is a cut-away plan view of the first MCB in a first "off" state.

Thus, the first MCB 1 enters a first "off" state, which is shown in FIG. 6.

Once the first MCB 1 has entered the first "off" state shown in FIG. 6, continued operation of the motor 25 in the reverse mode moves the slider 50 to its retracted position and rotates the first cam 32 away from the second cam 34. As the first cam 32 rotates, the second cam spring 35 biases the second cam 34 to follow the first cam 32 so as to move the second cam 34 towards its retracted position. Movement of the second cam 34 towards its retracted position moves the latch 38 (via the link 36) so that the latch re-engages with the trip lever 40 to be held in the recess 40*a* of the trip lever. Thus, the first MCB 1 returns to the "primed" state shown in FIGS. 2 and 3.

Once the first MCB 1 has returned to the "primed" state, the contacts 8, 10 can be re-closed by operating the motor 25 in its forward mode to return the first MCB 1 to the "on" state, as described above.

Operation of the trigger mechanism 60 to trigger the contact opening mechanism 30*b* (independently of the motor 25) into opening the contacts 8, 10 from the "on" state shown in FIGS. 4 and 5 shall now be described.

To open the contacts 8, 10 via the trigger mechanism 60, the control unit supplies a trip current from its capacitor to the electromechanical actuator 61. This actuates the electromechanical actuator 61 to push the armature 62 out of the aperture in the electromechanical actuator 61 and into contact with the actuator reset lever 72, causing the actuator reset lever 72 to rotate in an anticlockwise direction.

As the actuator reset lever 72 rotates, it moves into contact with the limb 78*b* of the spring release lever 78 and rotates the spring release lever 78 clockwise to move the lip 78*a* of the spring release lever 78 out of its blocking position so that the trip spring 74 quickly expands, releasing its stored mechanical energy to produce a large force which rotates the spring reset lever 76 at high speed in an anticlockwise direction as viewed in FIG. 7.

As the spring reset lever 76 rotates at high speed, it moves the trip pin 80 which in turn strikes the trip lever 40 with considerable force.

Rotation of the trip lever 40 by the trip pin 80 triggers the contact opening mechanism 30*b* into opening the contacts 8, 10 as described above.

In addition to triggering the contact opening mechanism 30*b* into opening the contacts 8, 10, the striking of the trip lever 40 by the trip pin 80 causes the trip lever 40 to rotate in an anticlockwise direction at high speed such that the trip lever 40 engages with the movable contact 10 so as to quickly rotate the movable contact 10 away from the fixed contact 8. In this process, momentum is transferred from the trip pin 80 to the movable contact 10 so as to mechanically assist in the opening of the contacts 8, 10.

The mechanical assistance in the opening of the contacts 8, 10 by the force transfer mechanism 70 is advantageous as it helps to reduce the time taken to open the contacts 8, 10 in response to an overcurrent condition and also helps to avoid welding together of the contacts 8, 10 (i.e. "tack" welding) if a very high short circuit current flows through the main current path 6, e.g. 1000 A to 2000 A.

Once the trigger mechanism 60 has triggered the contact opening mechanism 30*b* into opening the contacts 8, 10, the first MCB 1 enters a second "off" state in which the contacts 8, 10 are open and the trigger mechanism 60 is not primed (i.e. because the trip spring 74 has released its stored mechanical energy). The second "off" state is not illustrated.

Operation of the trip mechanism 60 to prime the trigger mechanism 60 from the second "off" state shall now be described.

In order to prime the trigger mechanism 60, the control unit 22 operates the motor 25 in its reverse mode, causing the slider 50 to move towards its retracted position which causes the slider lever 52 to rotate in a clockwise direction as viewed in FIG. 5.

As the slider lever 52 rotates in a clockwise direction as shown in FIG. 5, the link 77 connected to the slider lever 52 engages with the spring reset lever 76 so as to pull the spring reset lever to rotate in an anticlockwise direction as shown in FIG. 5. This action compresses the trip spring 74 and also allows the release lever spring 79 to move the spring release lever 78 back to its blocking position so that the lip 78*a* of the spring release lever 78 prevents the trip spring 74 from releasing its stored mechanical energy. Thus, operation of the motor 25 in the reverse direction primes the trigger mechanism by supplying mechanical energy to the trip spring 74. The first MCB 1 therefore returns to the "primed" state shown in FIGS. 2 and 3.

To re-close the contacts 8, 10 and return the first MCB 1 to the "on" state, the control unit 22 operates the motor 25 in its forwards mode as described above.

Figure 8:
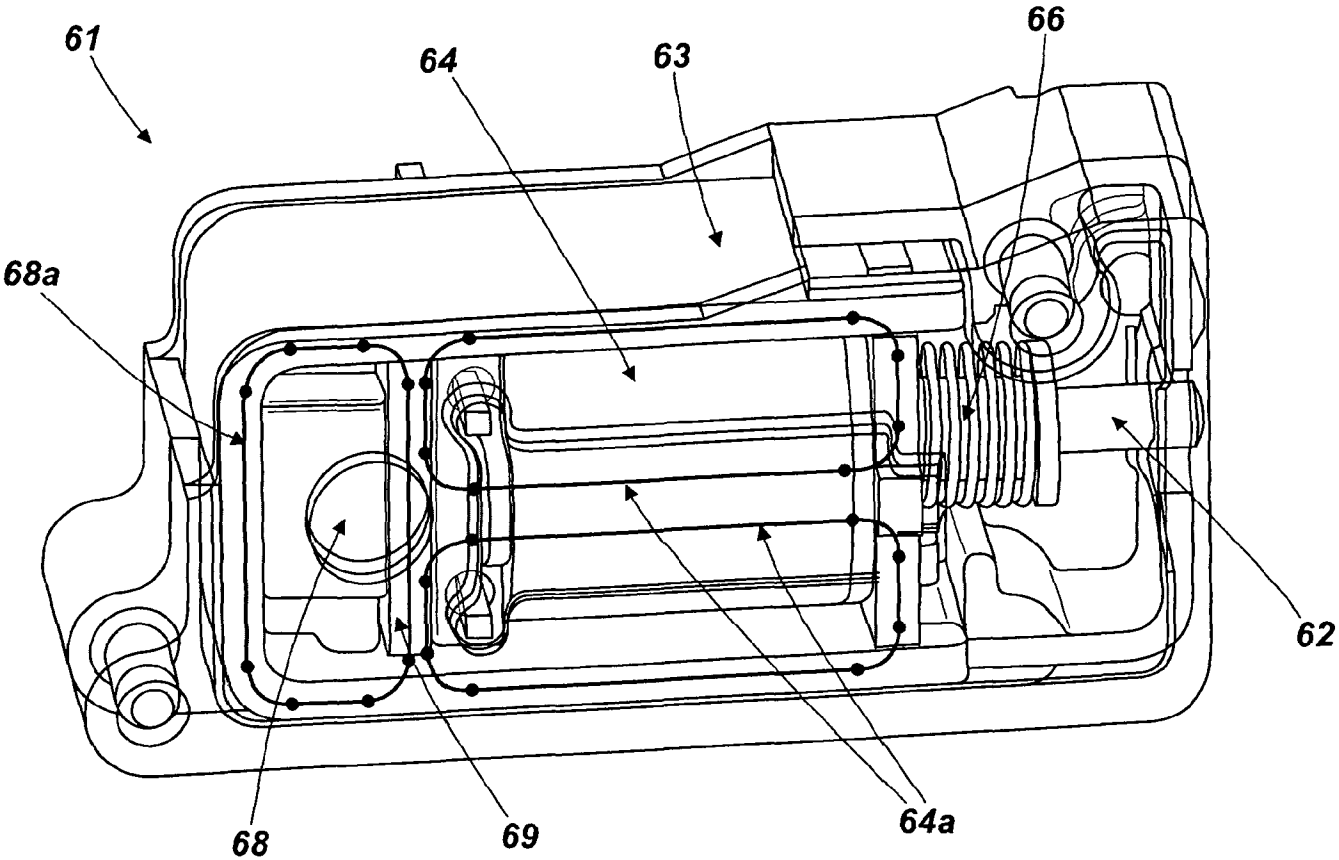
FIG. 8 is a cut-away perspective view of an electromechanical actuator of the MCB
Figure 9:
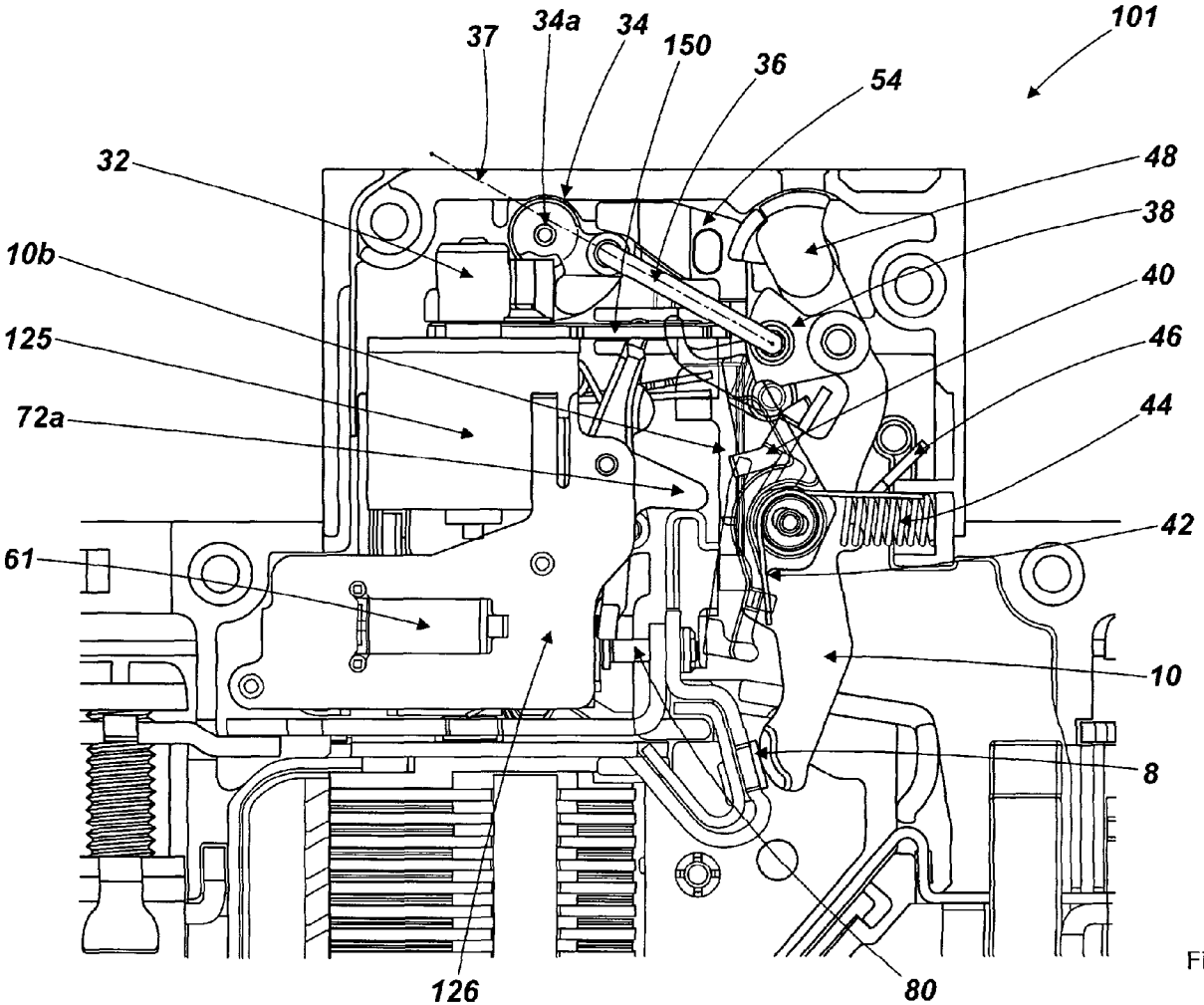
FIG. 9 is a cut-away plan view of a second MCB in an "on" state in which a trip lever is illustrated to be semi-transparent.
Figure 10:
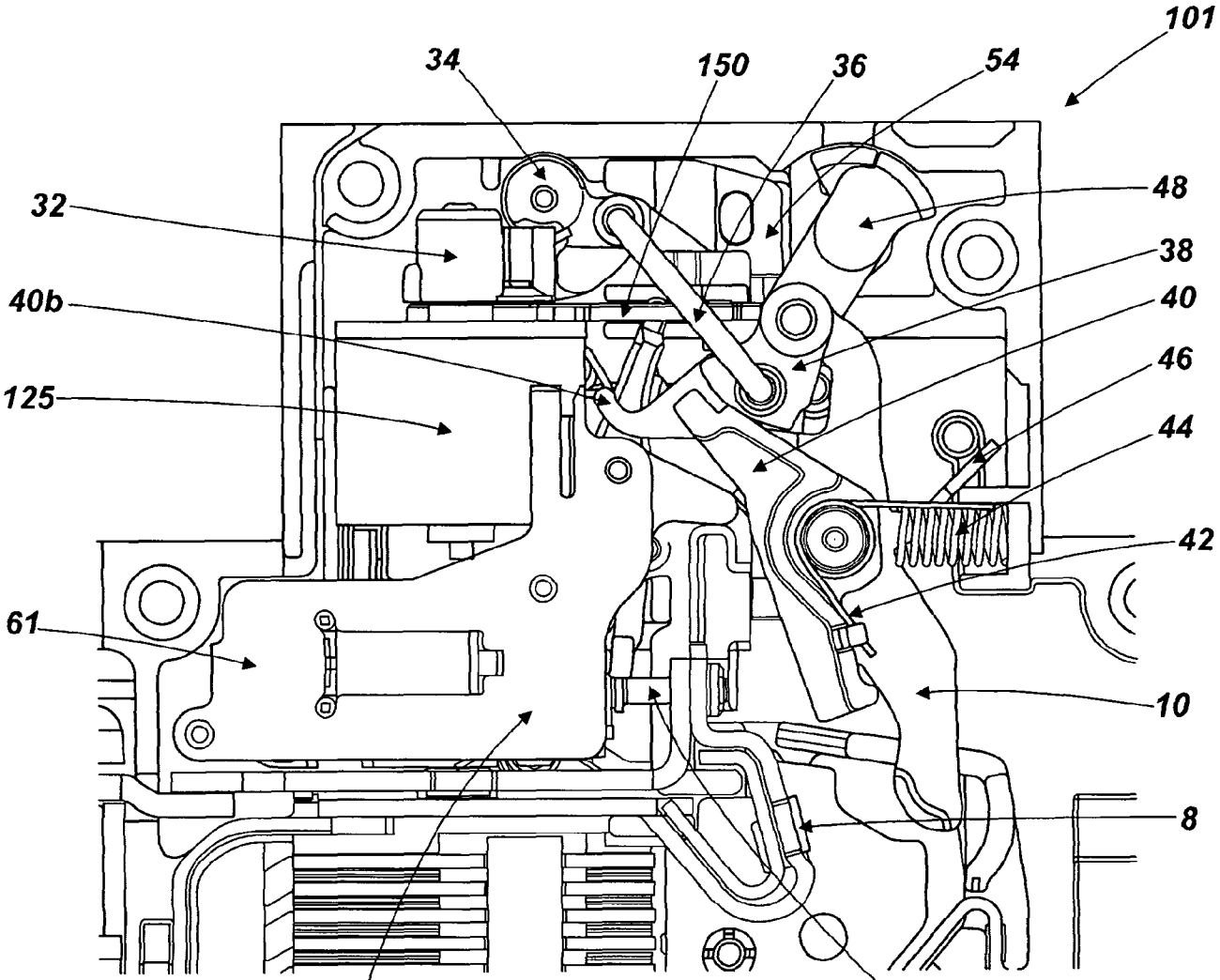
FIG. 10 is a cut-away plan view of the second MCB in a first "off" state.

FIG. 8 shows the electromechanical actuator 61 of the first MCB 1 in more detail.

As shown in FIG. 8, the electromechanical actuator 61 is a magnetically latched solenoid actuator having a frame 63 in which the armature 62, a coil 64, a release spring 66, a rare earth magnet 68 and a magnet plate 69 are housed. The armature 62 protrudes slightly from an aperture in the frame 63 of the electromechanical actuator 61. The frame 63, armature 62 and magnet plate 69 are of mild steel or soft iron.

The release spring 66 produces a spring force which acts on the armature 62 to bias the armature 62 to a position where it is pushed out of the aperture in the frame 63 of the electromechanical actuator 61.

The rare earth magnet 68 produces a magnetic field which is modified by the magnet plate 69 so as to produce a retaining force which acts on the armature 62. The retaining force balances the spring force in the absence of a current through the coil 64. Thus, when no current is supplied to the coil 64, the armature 62 is retained in the electromechanical actuator 61.

As explained above, if the control unit 22 determines that a short circuit condition occurs, then it produces a trip current which is supplied to the coil 64 of the electromechanical actuator 61. In most solenoids, a current through the coil of the solenoid produces a magnetic field which produces a force that acts on an armature to pull the armature into the solenoid. However, in the electromechanical actuator 61, the trip current through the coil 64 from the control unit 22 is of a polarity such that the current through the coil 64 produces a magnetic field which acts on the armature 62 with a force that unbalances the spring and retaining forces acting on the armature 62 so as to cause the spring force to overcome the retaining force. Once the spring force has overcome the retaining force, the release spring 66 acts on the armature 62 with a force that pushes the armature 62 out of the aperture, thus operating the electromechanical actuator 61. The rare earth magnet 68 and magnet plate 69 therefore act as a magnetic latch for the electromechanical actuator 61, the latch being released by the force produced by the trip current through the coil 64.

The spring pushes the armature 62 of the electromechanical actuator 61 with a larger force than the force on the armature 62 produced by the trip current flowing through the coil 64. Therefore, the release spring 66, rare earth magnet 68 and magnet plate 69 can be seen as a force transfer mechanism which transforms the force produced by the current through the coil 64 into a larger force. This force amplification helps the electromechanical actuator 61 to reduce the time taken for the trigger mechanism 60 to trigger the contact opening mechanism 30*b* into opening the contacts.

FIG. 8 shows the magnetic circuit 68*a* of the rare earth magnet 68 and the magnetic circuit 64*a* of the coil 64 when the current flows through the coil 64. As shown in FIG. 8, these magnetic circuits meet in the magnet plate 69.

The windings of the coil 64 can be varied in section and number to alter the number of amp-turns and pulse duration from discharge of the capacitor of the control unit 22. The capacitor discharge is preferably maximised so as to increase the magnitude of the actuation force and therefore minimise the time taken for the electromechanical actuator 61 to actuate in response to a trip current.

As explained previously, when the contact opening mechanism 30*b* has been triggered into opening the contacts 8, 10, a projection 10*b* (see FIG. 4) on the movable contact 12 engages a projection 72*a* on the actuator reset lever 72 to rotate the actuator reset lever 72 to push the armature 62 back into the electromechanical actuator 61, thus resetting the electromechanical actuator 61 by supplying mechanical energy to re-compress the release spring 66.

FIGS. 9 to 13 show a second MCB 101. Features of the second MCB 101 which are the same as those in the first MCB 1 are given identical reference numerals and shall not be discussed in further detail. Operation of the second MCB 101 between a "primed" state, an "on" state and first and second "off" states is as discussed with reference to the first MCB 1.

Figure 11:
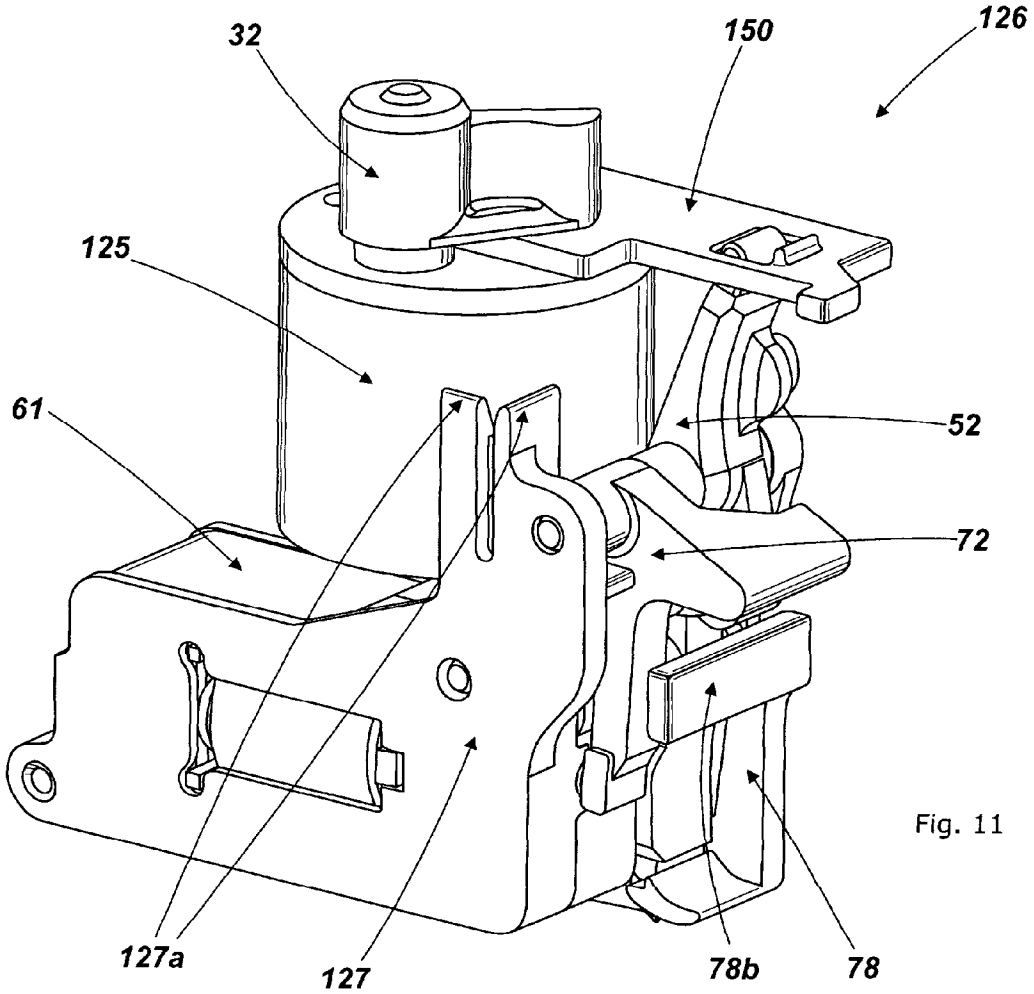
FIG. 11 is a perspective view of a motor subassembly of the second MCB
Figure 12:
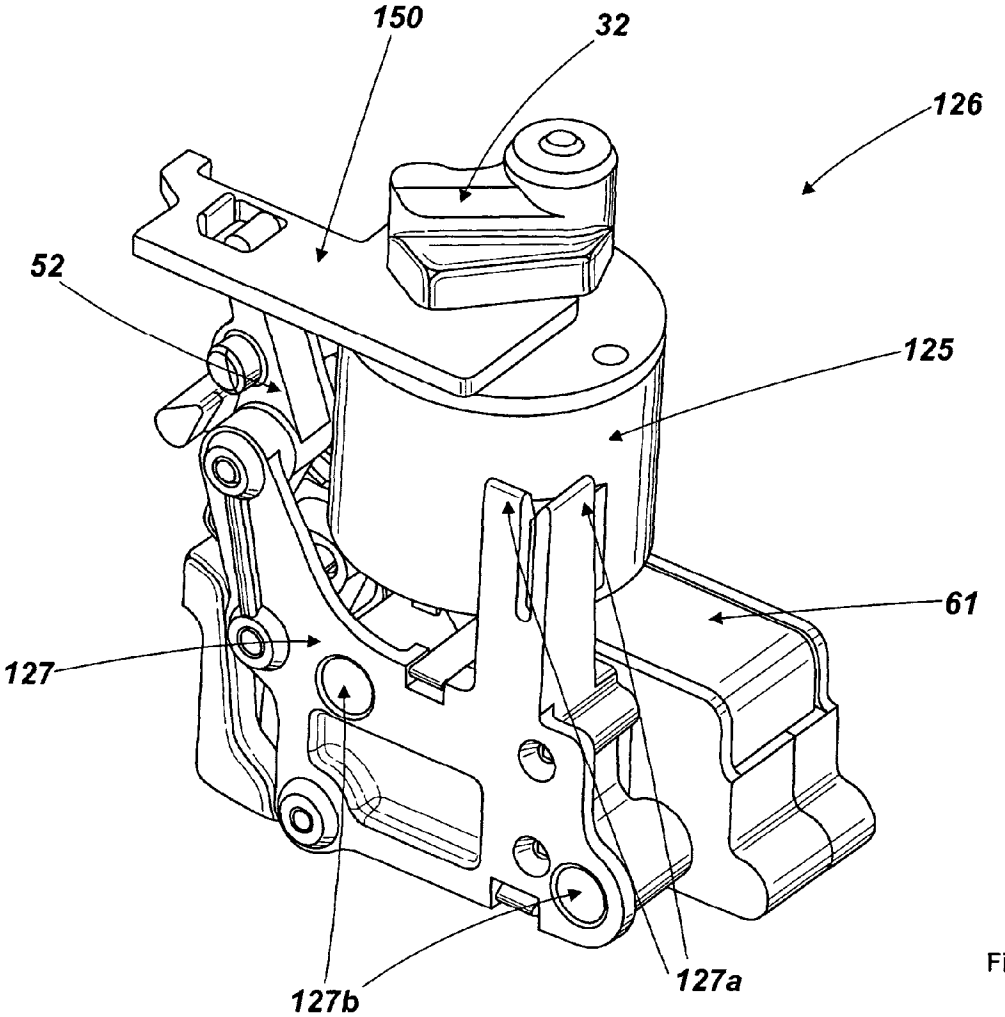
FIG. 12 is a perspective view of the motor subassembly module of the second MCB as viewed from an opposite side to that shown in FIG. 11.

The second MCB 101 has a motor 125 (see FIG. 13) which is part of a motor subassembly 126 (see FIGS. 11 and 12). The motor subassembly 126 includes a housing 127 which houses the motor 125, the first cam 32, a slider 150, the slider lever 52, the electromechanical actuator 61, the actuator reset lever 72, the trip spring 74, the spring reset lever 76, the spring release lever 78 and the release lever spring 79.

Figure 13:
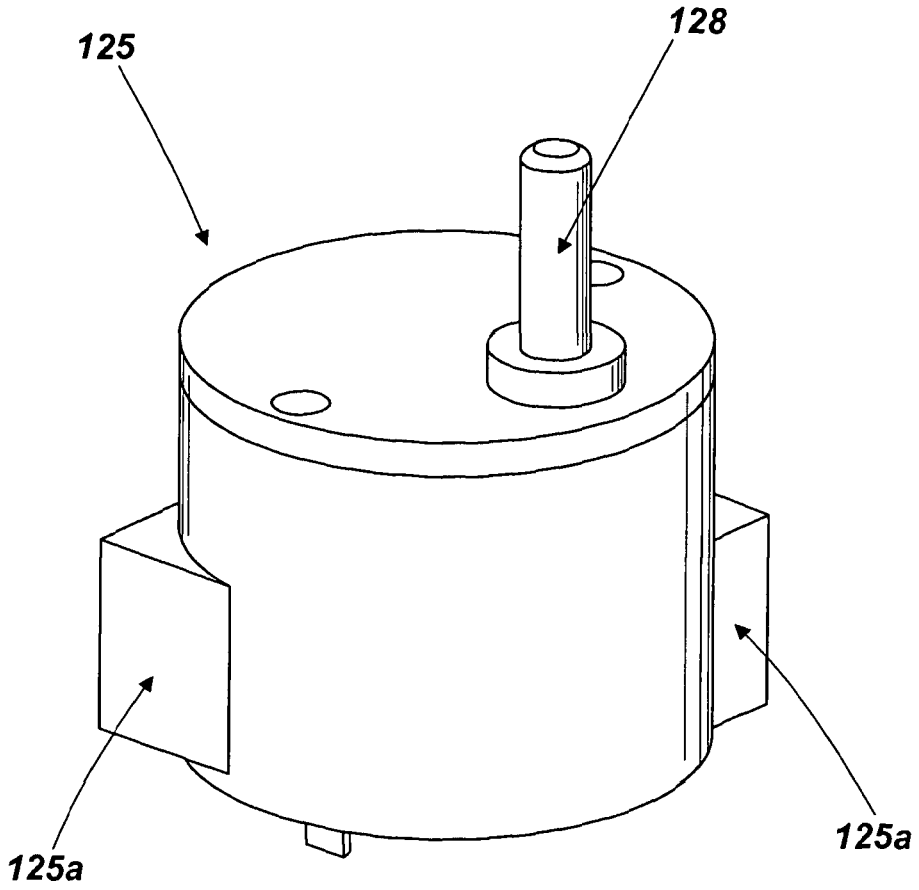
FIG. 13 is a perspective view of a motor of the second MCB.

The housing 127 of the motor subassembly 126 includes snap fit fingers 127*a* which allow the motor 125 to be snap fitted into position within the motor subassembly 126 via corresponding projections 125*a* on the motor 125 (see FIG. 13). Once the motor subassembly 126 has been mounted to the housing 12 of the second MCB 101, the snap fit fingers 127*a* are supported by the housing 12 such that they cannot be flexed to release the motor 125.

The housing 127 of the motor subassembly 126 defines holes 127*b* (see FIG. 12) which allow the motor subassembly 126 to be mounted to the housing 12 via corresponding spigots on the housing 12 (not shown). The motor subassembly 126 therefore helps to simplify the process of assembling the second MCB 101.

The slider 150 of the second MCB 101 functions in the same way as the slider 50 of the first MCB 1. However, the shape of the slider 150 is more plate-like, which improves the robustness of the slider 150. The slider 150 of the second MCB 101 is slidably mounted in a channel formed between the housing 12 of the second MCB 101 and the motor 125 and first cam 32, rather than in a motor mounting plate 26 as in the first MCB 1. The slider lever 52 connects to the slider 150 via an opening in the slider 150.

The backing for the fixed contact 8 shown in FIGS. 4, 6, 7, 9 and 10 is slightly inclined towards the movable contact 10 compared with the backing for the fixed contact 8 shown in FIGS. 2, 3 and 5. This optional feature helps to increase the distance between the upper part of the fixed contact backing and the movable contact 10.

One of ordinary skill after reading the foregoing description will be able to affect various changes, alterations, and subtractions of equivalents without departing from the broad concepts disclosed. It is therefore intended that the scope of the patent granted hereon be limited only by the appended claims, as interpreted with reference to the description and drawings, and not by limitation of the embodiments described herein.

For example, although the embodiments described above include a trip pin 80 which triggers a contact opening mechanism 30*b* by contacting a trip lever 40, the trip pin 80 could be omitted such that the spring reset lever 76 triggers the contact opening mechanism 30*b* by contacting the trip lever 40.

What is claimed is:

1. A miniature circuit breaker comprising:

a pair of openable contacts located in a main current path between a line terminal and a load terminal;

a trip mechanism for opening the contacts if an overcurrent condition occurs; and an electric motor operable to close the contacts via a contact closing mechanism;

wherein the trip mechanism includes:

a trigger mechanism and a contact opening mechanism, the trigger mechanism being arranged to trigger the contact opening mechanism into opening the contacts if a trip signal is produced;

a current sensor arranged to detect current through the main current path; and a control unit;

wherein the control unit is:

arranged to produce the trip signal to operate the trigger mechanism to trigger the trip mechanism into opening the contacts if it determines that a short circuit condition occurs based on an output of the current sensor; and is further arranged to operate the electric motor to trigger the contact opening mechanism into opening the contacts independently of the trigger mechanism if it determines that an overload condition occurs.

2. The miniature circuit breaker according to claim 1, wherein the contact opening mechanism includes a mechanical energy store arranged to release stored mechanical energy to open the contacts if the contact opening mechanism is triggered.

3. The miniature circuit breaker according to claim 2 wherein:

the contact opening mechanism includes a latch arranged such that the mechanical energy store releases stored mechanical energy to open the contacts if the latch is released; and the trigger mechanism is arranged to trigger the contact opening mechanism by releasing the latch.

4. The miniature circuit breaker according to claim 1, wherein the trigger mechanism includes an electromechanical actuator arranged to be operated by the trip signal to trigger the contact opening mechanism into opening the contacts if the trip signal is produced.

5. The miniature circuit breaker according to claim 4, wherein the electromechanical actuator includes a solenoid.

6. The miniature circuit breaker according to claim 5, wherein the electromechanical actuator includes a magnetically latchable solenoid actuator.

7. The miniature circuit breaker according to claim 1, wherein the trigger mechanism includes:

an electromechanical actuator arranged to be operated by the trip signal to produce a first trigger force;

a force transfer mechanism arranged to transform the first trigger force into a second trigger force larger than the first trigger force;

wherein the force transfer mechanism couples the electromechanical actuator to the contact opening mechanism such that the second trigger force triggers the contact opening mechanism into opening the contacts.

8. The miniature circuit breaker according to claim 1, wherein the control unit is arranged to operate the motor to close the contacts via a contact closing mechanism.

9. The miniature circuit breaker according to claim 1, wherein the contact closing mechanism includes a mechanical energy store arranged to accumulate mechanical energy from operation of the closing actuator and subsequently to release accumulated mechanical energy to close the contacts.

10. The miniature circuit breaker according to claim 1, wherein the miniature circuit breaker has a housing which contains the electric motor and the housing of the miniature circuit breaker complies with the DIN 43880 standard.

11. The miniature circuit breaker according to claim 1, wherein:

the trip mechanism includes a trigger mechanism and a contact opening mechanism, the trigger mechanism being arranged to trigger the contact opening mechanism into opening the contacts if an overcurrent condition occurs;

the electric motor is operable to prime the trip mechanism by supplying mechanical energy to a mechanical energy store of the trip mechanism.

12. The miniature circuit breaker according claim 1, wherein the electric motor is operable in a first mode in which a rotatable element of the electric motor rotates in a first direction and a second mode in which the rotatable element rotates in a second direction opposite to the first direction and wherein the electric motor is operable in the first mode to close the contacts and in the second mode to prime the trip mechanism.

13. The miniature circuit breaker according to claim 1, wherein the trip signal is a trip current.

14. The miniature circuit breaker according to claim 1, wherein the control unit includes an electrical energy store arranged to produce the trip current.

15. The miniature circuit breaker according to claim 14, wherein the electrical energy store includes a capacitor.

16. The miniature circuit breaker according to claim 1, wherein the control unit is arranged to determine whether an overcurrent condition occurs based on a threshold value.

17. The miniature circuit breaker according to claim 16, wherein the threshold value is adjustable.

18. The miniature circuit breaker according to claim 1, wherein the control unit is arranged to determine whether an overcurrent condition occurs based on a rated current, an instantaneous tripping current and/or an instantaneous tripping type.

19. The miniature circuit breaker according to claim 18, wherein the rated current, instantaneous tripping current and/or instantaneous tripping type is adjustable.

20. A miniature circuit breaker comprising:

a pair of openable contacts located in a main current path between a line terminal and a load terminal;

a trip mechanism for opening the contacts if an overcurrent condition occurs; and an electric motor operable to close the contacts via a contact closing mechanism;

wherein the trip mechanism includes:

a trigger mechanism and a contact opening mechanism, the trigger mechanism being arranged to trigger the contact opening mechanism into opening the contacts if a trip signal is produced;

a current sensor arranged to detect current through the main current path; and a control unit;

wherein the control unit is:

arranged to produce the trip signal to operate the trigger mechanism to trigger the trip mechanism into opening the contacts if it determines that a short circuit condition occurs based on an output of the current sensor; and is further arranged to operate the electric motor to trigger the contact opening mechanism into opening the contacts independently of the trigger mechanism if it determines that an overload condition occurs;

wherein the contact opening mechanism includes a mechanical energy store arranged to release stored mechanical energy to open the contacts if the contact opening mechanism is triggered;

wherein the contact opening mechanism includes a latch arranged such that the mechanical energy store releases stored mechanical energy to open the contacts if the latch is released;

wherein the trigger mechanism is arranged to trigger the contact opening mechanism by releasing the latch;

wherein the trigger mechanism includes a solenoid arranged to be operated by the trip signal to trigger the contact opening mechanism into opening the contacts if the trip signal is produced;

wherein the control unit includes an electrical energy store arranged to produce the trip current.

* * * * *